US007244008B2

(12) United States Patent
Hiwada et al.

(10) Patent No.: US 7,244,008 B2
(45) Date of Patent: Jul. 17, 2007

(54) DRIVING APPARATUS FOR DRIVING INK JET RECORDING DEVICE, AND INK JET PRINTER

(75) Inventors: Shuhei Hiwada, Toyoake (JP); Tsuyoshi Suzuki, Owariasahi (JP)

(73) Assignee: Brother Kogyo Kabushiki Kaisha, Nagoya-shi, Aichiken (JP)

( * ) Notice: Subject to any disclaimer, the term of this patent is extended or adjusted under 35 U.S.C. 154(b) by 289 days.

(21) Appl. No.: 11/099,532

(22) Filed: Apr. 6, 2005

(65) Prior Publication Data

US 2005/0219280 A1 Oct. 6, 2005

(30) Foreign Application Priority Data

Apr. 6, 2004 (JP) ..... 2004-111697

(51) Int. Cl.
*B41J 29/38* (2006.01)

(52) U.S. Cl. ..... 347/12; 347/10; 347/11

(58) Field of Classification Search ..... 347/10, 347/11, 12, 14, 9
See application file for complete search history.

(56) References Cited

U.S. PATENT DOCUMENTS

| | | | | |
|---|---|---|---|---|
| 6,676,238 | B2 * | 1/2004 | Fujimura et al. | 347/11 |
| 6,857,715 | B2 * | 2/2005 | Darling | 347/11 |
| 2005/0093903 | A1 * | 5/2005 | Darling | 347/11 |

FOREIGN PATENT DOCUMENTS

| | | |
|---|---|---|
| JP | 2003-237078 | 8/2003 |

* cited by examiner

*Primary Examiner*—Lamson Nguyen
(74) *Attorney, Agent, or Firm*—Banner & Witcoff, Ltd

(57) ABSTRACT

An apparatus for driving an ink jet printer including actuators for first and second pressure chambers communicating with first and second nozzles, the printer operating in a first mode in which the first and second nozzles are permitted to eject a first and a second ink and in a second mode in which only the first nozzles are permitted to eject the first ink, the apparatus including an obtainer which obtains a mode signal indicating in which one of the first and second modes the printer is to operate, and image data indicating whether each of the first and second nozzles is to eject a corresponding one of the first and second inks; and an applier which applies, based on the signal and the data, a voltage to each actuator such that when the printer is to operate in the first mode, a first voltage not equal to zero V is applied to an actuator corresponding to an operative nozzle of the first and second nozzles that is to eject a corresponding one of the first and second inks and subsequently a first subsequent voltage based on the data is applied to the actuator corresponding to the operative nozzle of the first and second nozzles, and such that when the printer is to operate in the second mode, the first voltage is applied to an actuator corresponding to an operative nozzle of the first nozzles that is to eject the first ink and subsequently a second subsequent voltage based on the image data is applied to the actuator corresponding to the operative nozzle of the first nozzles, and a second voltage equal to zero V is applied to one or more actuators corresponding to the one or more second nozzles.

13 Claims, 16 Drawing Sheets

FIG.14

| RECORDING HEADS (NOZZLE ARRAYS) | FULL-COLOR PRINT MODE | | MONOCHROMATIC PRINT MODE |
|---|---|---|---|
| Y M C | OPERATIVE NOZZLE(S) | EJECTION SIGNAL | STAND-BY CANCEL SIGNAL |
| | STAND-BY NOZZLE(S) | STAND-BY SIGNAL | |
| Bk | OPERATIVE NOZZLE(S) | EJECTION SIGNAL | EJECTION SIGNAL |
| | STAND-BY NOZZLE(S) | STAND-BY SIGNAL | STAND-BY SIGNAL |

DRIVING APPARATUS FOR DRIVING INK JET RECORDING DEVICE, AND INK JET PRINTER

The present application is based on Japanese Patent Application No 2004-111697 filed on Apr. 6, 2004, the contents of which are incorporated herein by reference.

BACKGROUND OF THE INVENTION

1. Field of the Invention

The present invention relates to a driving apparatus for driving a plurality of actuators of an ink jet recording device, and additionally relates to an ink jet printer including a plurality of actuators and a driving apparatus for driving the actuators.

2. Discussion of Related Art

There is known a piezoelectric-type ink jet recording head including a plurality of nozzles for ejecting ink; a plurality of pressure chambers communicating with the nozzles, respectively; and a plurality of piezoelectric actuators opposed to the pressure chambers, respectively. The pressure chambers also communicate with a common ink chamber for supplying the ink to each of the pressure chambers. Each of the piezoelectric actuators includes a piezoelectric element and two electrodes sandwiching the piezoelectric element. When respective electric potentials of the two electrodes sandwiching the piezoelectric element are equal to each other, i.e., an electric voltage equal to zero volt (i.e., 0 V) is applied across the two electrodes, the each piezoelectric actuator is not deformed. However, when the respective electric potentials of the two electrodes are not equal to each other, i.e., an electric voltage not equal to 0 V is applied to the two electrodes, the each piezoelectric actuator is so deformed as to decrease a volume of a corresponding one of the pressure chambers. Therefore, in the ink jet recording head, if an electric voltage equal to 0 V and subsequently an electric voltage not equal to 0 V are applied to each piezoelectric actuator, a corresponding one of the nozzles ejects a droplet of ink.

Japanese Patent Application Publication P2003-237078A1 discloses a piezoelectric-type ink jet recording head employing, as a piezoelectric-actuator driving method, a so-called "fill-before-fire" method. In this method, first, an electric voltage not equal to 0 V is applied, as a stand-by voltage, to each one of piezoelectric actuators so as to decrease a volume of a corresponding one of pressure chambers, and subsequently an electric voltage equal to 0 V is applied to the each actuator so as to produce a negative pressure in the one pressure chamber. The thus produced negative pressure propagates as a pressure wave from the one pressure chamber to a common ink chamber and, when the negative pressure reflects at the common ink chamber, the negative pressure obtains an inverted phase and returns as a positive pressure to the one pressure chamber. Then, at a timing when the positive pressure arrives at the one pressure chamber, an electric voltage not equal to 0 V is applied to the each actuator so as to decrease the volume of the one pressure chamber. Since the thus produced positive pressure overlaps the returning positive pressure, an increased positive pressure is produced in the one pressure chamber. Thus, owing to the "fill-before-fire" method, each nozzle can eject a droplet of ink at a high speed without needing to applying a high voltage to each actuator.

SUMMARY OF THE INVENTION

Meanwhile, generally, a full-color ink jet printer includes a plurality of arrays of nozzles such that each array of nozzles includes a plurality of nozzles arranged in one direction and the plurality of arrays of nozzles eject a plurality of sorts of inks, respectively, that have different colors. When the full-color ink jet printer carries out a printing operation, one or more arrays of nozzles as a portion of all the arrays of nozzles may not be used depending upon image data. For example, when a document including characters only is printed with a single color, i.e., a single sort of ink (e.g., a black ink), the single sort of ink is ejected from only the nozzles belonging to one or more pre-selected arrays of nozzles, and no inks are ejected from the other arrays of nozzles.

When the full-color ink jet printer carries out a printing operation in the "fill-before-fire" method, an electric voltage not equal to 0 V is applied, when the printing operation is started, to each one of the piezoelectric actuators corresponding to the operative nozzles that are to eject the ink, so that those actuators are prepared for ejecting the ink from the operative nozzles. Subsequently, an electric voltage that is cyclically made equal to 0 V and then not equal to 0 V, according to the image data, is applied to the each actuator. On the other hand, each of the piezoelectric actuators corresponding to the stand-by nozzles that are not to eject the ink, also receives the electric voltage not equal to 0 V, when the printing operation is started, like each of the actuators corresponding to the operative nozzles, and continues receiving the electric voltage till the printing operation is finished, because to provide a plurality of drive circuits for driving the arrays of nozzles, respectively, leads to increasing the total number of parts and the overall production cost. However, since recently there is a tendency that full-color ink jet printers employ an increased number of nozzles, a pitch at which electrodes are arranged and a pitch at which electric wires connected to the electrodes are arranged tend to be decreased, so that the phenomenon of "migration" may occur, where some components of the ink migrate electrolytically through the piezoelectric elements toward the electrodes. Thus, if each piezoelectric actuator continues receiving an electric voltage not equal to 0 V for a long time, electric short-circuit may occur across two electrodes arranged adjacent each other.

In the above-described technical background, the present invention has been developed. It is therefore an object of the present invention to provide a driving apparatus for driving an ink jet recording device, that is free of the problem that electric short-circuit may occur across actuators, and an ink jet printer including the driving apparatus.

According to a first aspect of the present invention, there is provided a driving apparatus for driving an ink jet recording device including a plurality of pressure chambers; a plurality of actuators to each of which a first voltage is applied to decrease a volume of a corresponding one of the pressure chambers from the volume of the one pressure chamber when a second voltage whose absolute value is smaller than an absolute value of the first voltage is applied to the each actuator; at least one first nozzle of a first group that communicates with at least one first pressure chamber of the pressure chambers; and at least one second nozzle of a second group that communicates with at least one second pressure chamber of the pressure chambers that is different from the at least one first pressure chamber. The ink jet recording device selectively operates in a first recording mode in which the at least one first nozzle is permitted to eject a first ink and the at least one second nozzle is permitted to eject a second ink, and in a second recording mode in which the at least one first nozzle is permitted to eject the first ink and the at least one second nozzle is not permitted to eject the second ink. The driving apparatus comprises an ejection-signal producer which produces an ejection signal to apply, to the each actuator, at least one voltage cycle including a third voltage, a fourth voltage subsequent to the third voltage, and a fifth voltage subsequent to the fourth voltage. When the fourth voltage is applied to the each actuator, the volume of the one pressure chamber is increased from the volume of the one pressure chamber when the third voltage is applied to the each actuator, and when the fifth voltage is applied to the each actuator, the volume of the one pressure chamber is decreased from the volume of the one pressure chamber when the fourth voltage is applied to the each actuator. The driving apparatus additionally comprises a stand-by-signal producer which produces a stand-by signal to keep applying the first voltage to the each actuator; a pause-signal producer which produces a pause signal to keep applying the second voltage to the each actuator; and a signal selector which selects, based on a mode signal indicating in which one of the first and second recording modes the ink jet recording device is to operate, and image data indicating whether each of the at least one first nozzle and the at least one second nozzle is to eject a corresponding one of the first ink and the second ink, one of the ejection signal the stand-by signal and the pause signal, such that when the ink jet recording device is to operate in the first recording mode, the ejection signal is selected as the one signal for being applied to at least one actuator corresponding to at least one operative nozzle of the at least one first nozzle and the at least one second nozzle that is to eject a corresponding one of the first ink and the second ink, and the stand-by signal is selected as the one signal for being applied to at least one actuator corresponding to at least one stand-by nozzle of the at least one first nozzle and the at least one second nozzle that is not to eject a corresponding one of the first ink and the second ink, and such that when the ink jet recording device is to operate in the second recording mode, the ejection signal is selected as the one signal for being applied to at least one actuator corresponding to at least one operative nozzle of the at least one first nozzle that is to eject the first ink, the stand-by signal is selected as the one signal for being applied to at least one actuator corresponding to at least one stand-by nozzle of the at least one first nozzle that is not to eject the first ink, and the pause signal is selected as the one signal for being applied to at least one actuator corresponding to the at least one second nozzle.

In the driving apparatus constructed as described above, when the ink jet recording device is to operate in the second recording mode (e.g., a monochromatic print mode), the pause signal (e.g., a stand-by cancel signal) is selected for being applied to one or more actuators (e.g., piezoelectric actuators) corresponding to one or more second nozzles (e.g., chromatic-ink ejection nozzles). Therefore, a time period in which one or more actuators corresponding to one or more second nozzles receive the first voltage whose absolute value is greater than that of the second voltage is largely reduced. Thus, the present driving apparatus is freed of the problem that electric short-circuit may occur, and one or more actuators may fail, because of "migration".

According to a second aspect of the present invention, there is provided a driving apparatus for driving an ink jet recording device including a plurality of pressure chambers; a plurality of actuators each of which actuates a corresponding one of the pressure chambers; at least one first nozzle of a first group that communicates with at least one first pressure chamber of the pressure chambers; and at least one second nozzle of a second group that communicates with at least one second pressure chamber of the pressure chambers that is different from the at least one first pressure chamber. The ink jet recording device selectively operates in a first recording mode in which the at least one first nozzle is permitted to eject a first ink and the at least one second nozzle is permitted to eject a second ink, and in a second recording mode in which the at least one first nozzle is permitted to eject the first ink and the at least one second nozzle is not permitted to eject the second ink. The driving apparatus comprises a signal-and-data obtainer which obtains a mode signal indicating in which one of the first and second recording modes the ink jet recording device is to operate, and image data indicating whether each of the at least one first nozzle and the at least one second nozzle is to eject a corresponding one of the first ink and the second ink; and a voltage applier which applies, based on the mode signal and the image data obtained by the signal-and-data obtainer, an electric voltage to the each actuator, such that when the ink jet recording device is to operate in the first recording mode, a first voltage not equal to zero volt is applied to at least one actuator corresponding to at least one operative nozzle of the at least one first nozzle and the at least one second nozzle that is to eject a corresponding one of the first ink and the second ink, so that a corresponding one of the pressure chambers has a pre-determined volume, and subsequently at least one first subsequent voltage based on the image data is applied to the at least one actuator corresponding to the at least one operative nozzle of the at least one first nozzle and the at least one second nozzle, and such that when the ink jet recording device is to operate in the second recording mode, the first voltage is applied to at least one actuator corresponding to at least one operative nozzle of the at least one first nozzle that is to eject the first ink, and subsequently at least one second subsequent voltage based on the image data is applied to the at least one actuator corresponding to the at least one operative nozzle of the at least one first nozzle, and a second voltage equal to zero volt is applied to at least one actuator corresponding to the at least one second nozzle.

The driving apparatus in accordance with the second aspect of the present invention is also freed of the problem that electric short-circuit may occur, and one or more actuators may fail, because of "migration".

According to a third aspect of the present invention, there is provided an ink jet printer comprising an ink jet recording device; and a driving device which drives the ink jet recording device. The ink jet recording device comprises a plurality of pressure chambers, a plurality of actuators to each of which a first voltage is applied to decrease a volume of a corresponding one of the pressure chambers from the volume of the one pressure chamber when a second voltage whose absolute value is smaller than an absolute value of the first voltage is applied to the each actuator, at least one first nozzle of a first group that communicates with at least one first pressure chamber of the pressure chambers, and at least one second nozzle of a second group that communicates with at least one second pressure chamber of the pressure chambers that is different from the at least one first pressure chamber. The ink jet recording device selectively operates in a first recording mode in which the at least one first nozzle is permitted to eject a first ink and the at least one second nozzle is permitted to eject a second ink, and in a second recording mode in which the at least one first nozzle is permitted to eject the first ink and the at least one second nozzle is not permitted to eject the second ink. The driving device comprises an ejection-signal producer which produces an ejection signal to apply, to the each actuator, at least one voltage cycle including a third voltage, a fourth voltage subsequent to the third voltage, and a fifth voltage subsequent to the fourth voltage, wherein when the fourth voltage is applied to the each actuator, the volume of the one pressure chamber is increased from the volume of the one pressure chamber when the third voltage is applied to the each actuator, and when the fifth voltage is applied to the each actuator, the volume of the one pressure chamber is decreased from the volume of the one pressure chamber when the fourth voltage is applied to the each actuator, a stand-by-signal producer which produces a stand-by signal to keep applying the first voltage to the each actuator, a pause-signal producer which produces a pause signal to keep applying the second voltage to the each actuator, and a signal selector which selects, based on a mode signal indicating in which one of the first and second recording modes the ink jet recording device is to operate, and image data indicating whether each of the at least one first nozzle and the at least one second nozzle is to eject a corresponding one of the first ink and the second ink, one of the ejection signal the stand-by signal and the pause signal, such that when the ink jet recording device is to operate in the first recording mode, the ejection signal is selected as the one signal for being applied to at least one actuator corresponding to at least one operative nozzle of the at least one first nozzle and the at least one second nozzle that is to eject a corresponding one of the first ink and the second ink, and the stand-by signal is selected as the one signal for being applied to at least one actuator corresponding to at least one stand-by nozzle of the at least one first nozzle and the at least one second nozzle that is not to eject a corresponding one of the first and second inks, and such that when the ink jet recording device is to operate in the second recording mode, the ejection signal is selected as the one signal for being applied to at least one actuator corresponding to at least one operative nozzle of the at least one first nozzle that is to eject the first ink, the stand-by signal is selected as the one signal for being applied to at least one actuator corresponding to at least one stand-by nozzle of the at least one first nozzle that is not to eject the first ink, and the pause signal is selected as the one signal for being applied to at least one actuator corresponding to the at least one second nozzle.

The ink jet printer in accordance with the third aspect of the present invention is also freed of the problem that electric short-circuit may occur, and one or more actuators may fail, because of "migration".

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 14 is a table showing a relationship between (A) (a1) full-color and monochromatic print modes and (a2) operative and stand-by nozzles corresponding to chromatic (yellow, magenta, and cyan) inks and operative and stand-by nozzles corresponding to a monochromatic (black) ink, and (B) ejection, stand-by, and stand-by cancel signals supplied to each piezoelectric actuator;

DETAILED DESCRIPTION OF THE PREFERRED EMBODIMENTS

Hereinafter, there will be described preferred embodiments of the present invention by reference to the drawings.

Figure 1:
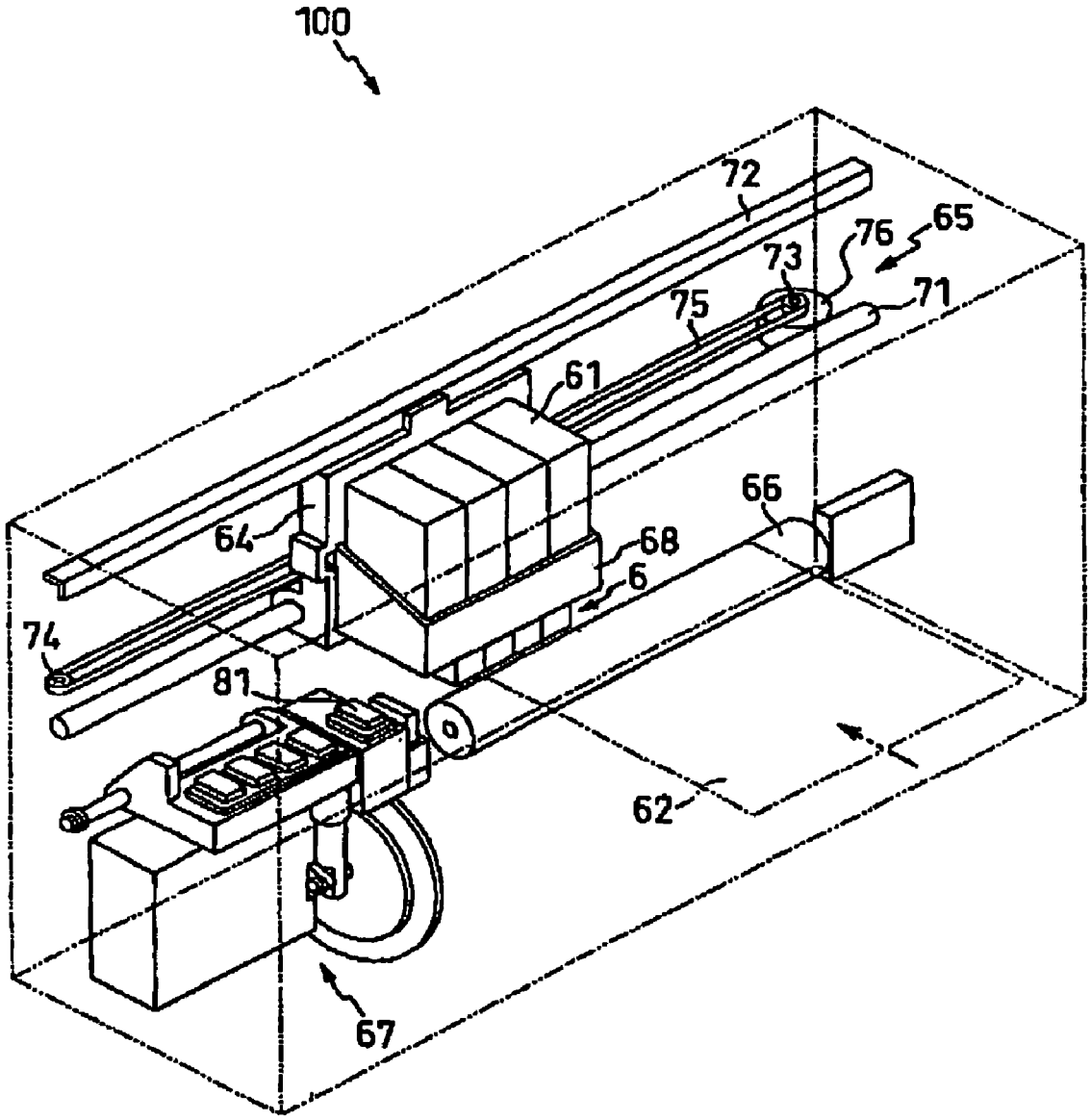
FIG. 1 is a perspective view of an ink jet printer as a first embodiment of the present invention.

First, there will be described a construction of a fill-color ink jet printer 100 as a first embodiment of the present invention, by reference to FIGS. 1 through 7. As shown in FIG. 1, the full-color ink jet printer 100 includes a frame member 68 to which four piezoelectric recording heads 6 are fixed. The four recording heads 6 eject four color inks (i.e., a cyan ink, a magenta ink, a yellow ink, and a black ink), respectively. In addition, four ink cartridges 61 that store the four color inks, respectively, are detachably attached to the frame member 68. The frame member 68 is fixed to a carriage 64 that is linearly reciprocated by a moving device 65. A platen roller 66 that feeds a recording sheet 62 is provided such that the roller 66 extends parallel to directions of reciprocation of the carriage 64 and is opposed to the four recording heads 6. The four recording heads 6 constitute an ink jet recording device.

The carriage 64 is supported by a guide bar 71 and a guide plate 72 that extend parallel to the platen roller 66, such that the carriage 64 is slideable on the guide bar 71 and the guide plate 72. The above-indicated moving device 65 includes two pulleys 73, 74 that are provided in respective vicinities of opposite end portions of the guide bar 71, and an endless belt 75 that is wound around the two pulleys 73, 74. The carriage 64 is fixed to a portion of the endless belt 75. The moving device 65 additionally includes an electric motor 76 that is connected to one 73 of the two pulleys 73, 74. When the pulley 73 is rotated forward or backward by the motor 76, the carriage 64 is linearly reciprocated along the guide bar 71 and the guide plate 72, so that the recording heads 6 are also reciprocated.

The recording sheet 62 is fed from a sheet-feed cassette, not shown, that is externally attached to the ink jet printer 100, and is introduced into a space present between the recording heads 6 and the platen roller 66. After the recording heads 6 eject droplets of inks toward the recording sheet 62 and thereby record characters, symbols, etc. on the sheet 62, the sheet 62 is discharged out of the printer 100.

A purging device 67 is for sucking and removing, from the recording heads 6, bad inks containing air bubbles and/or dust. The purging device 67 is provided on one side of the platen roller 66, such that when the recording heads 6 are moved to a resetting position by the moving device 65, the purging device 67 is opposed to the recording heads 6. The purging device 67 includes a purging cap 81 that is adapted to contact a lower end portion of each of the recording heads 6 and thereby cover a number of nozzles 35 (FIGS. 3 through 5) opening in a lower surface of the each recording head 6.

Figure 2:
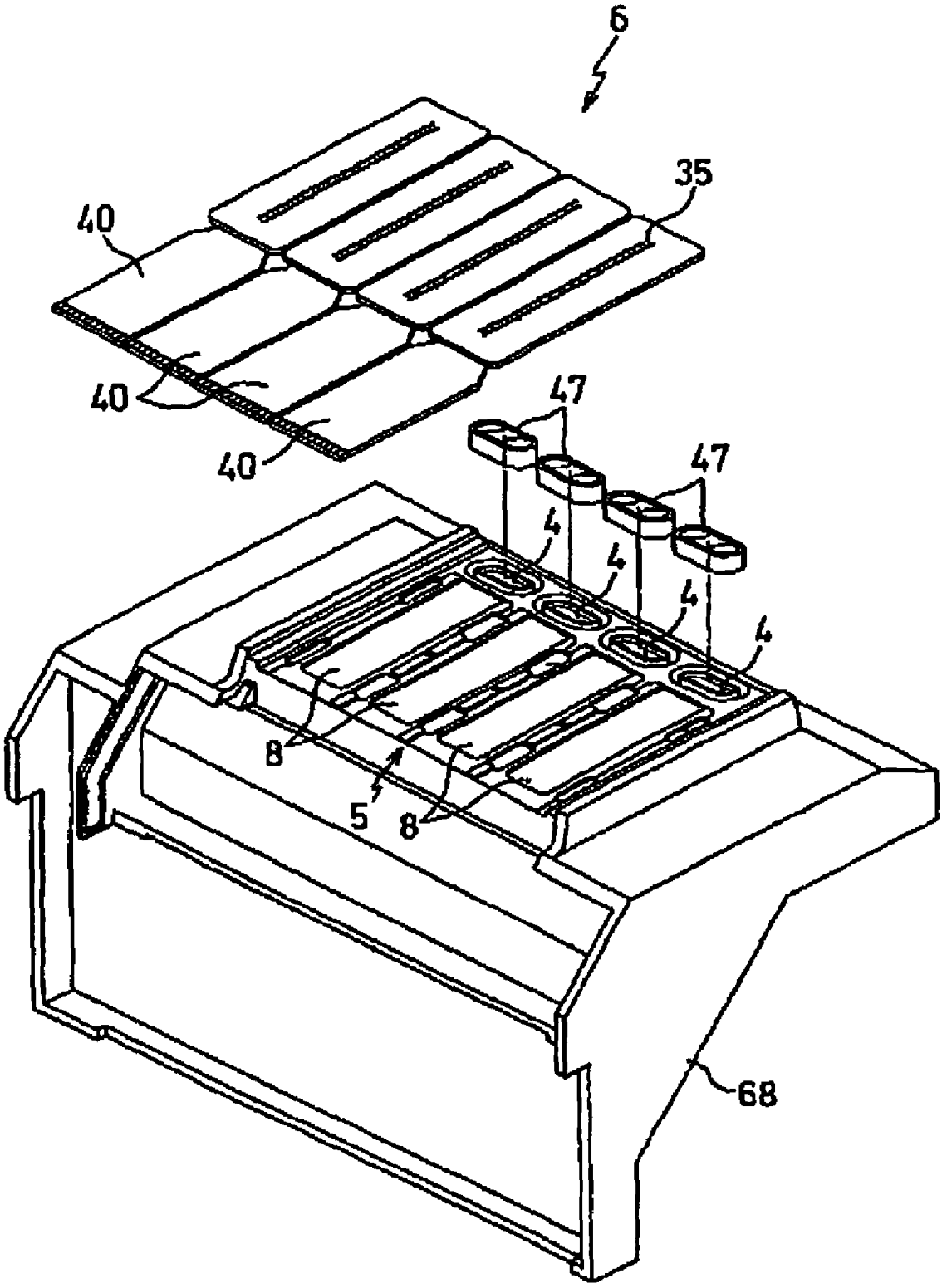
FIG. 2 is an exploded, perspective view of recording heads, and a frame member, of the ink jet printer.

FIG. 2 is an exploded perspective view showing the recording heads 6 and the frame member 68 upside down. The frame member 68 has a generally box-like shape opening upward (i.e., downward as seen in the figure), so that the ink cartridges 61 may be detachably attached to the frame member 68 while being moved downward. As shown in the figure, the frame member 68 has four ink supply passages 4 that are connectable to respective ink flow outlets, not shown, provided in respective lower end portions of the four ink cartridges 61 and communicate with a lower surface of a bottom wall 5 of the frame member 68 where the recording heads 6 are fixed. Four rubber-based joint members 47 are attached to the lower surface of the bottom wall 5, such that the four joint members 47 correspond to the four ink supply passages 4, respectively, and are liquid-tightly contactable with respective ink flow inlets 39 (FIG. 3) of the four recording heads 6. The frame member 68 has, in the lower surface of the bottom wall 5 thereof, four recessed portions 8 that are arranged in an array and in which the four recording heads 66 are provided, respectively. Thus, the four recording heads 66 are arranged in an array. Each of the four recording heads 66 is fixedly adhered with, e.g., an ultraviolet-curing adhesive, to a corresponding one of the four recessed portions 8.

Figure 3:
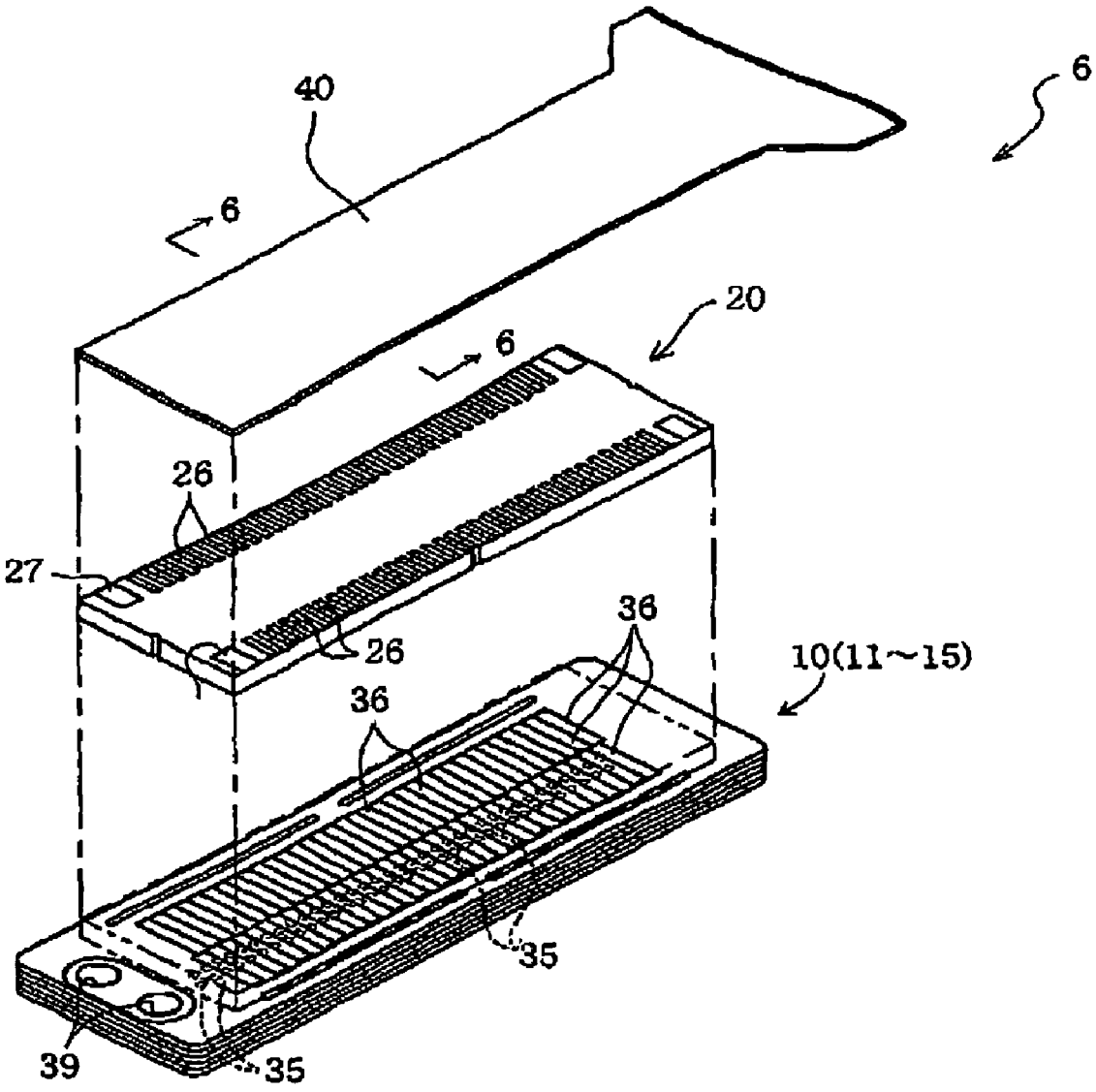
FIG. 3 is an exploded, perspective view of one of the recording heads.
Figure 8:
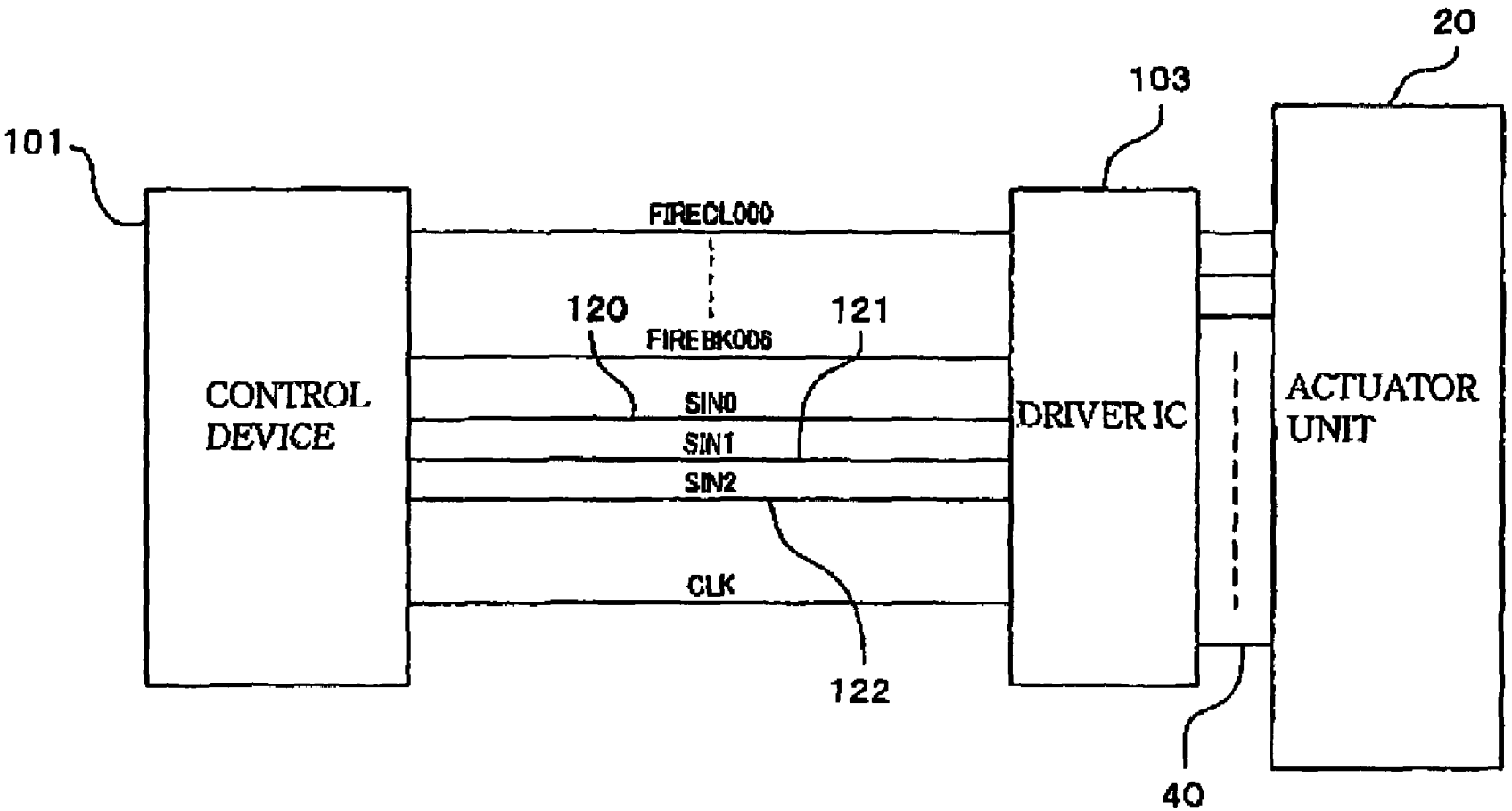
FIG. 8 is a diagrammatic view showing an electric connection between a control device and each of the recording heads.

FIG. 3 shows one of the four recording heads 6 that have an identical construction. Each recording head 6 includes a stacked-type channel unit 10; a flat actuator unit 20 that is adhered to an upper surface of the channel unit 10; and a flexible flat cable 40 that is bonded to an upper surface of the actuator unit 20 so as to connect electrically the actuator unit 20 to a driver IC (integrated circuit) 103 (FIG. 8). The nozzles 35 open in a lower surface of the channel unit 10, and eject droplets of ink in a downward direction.

Figure 4:
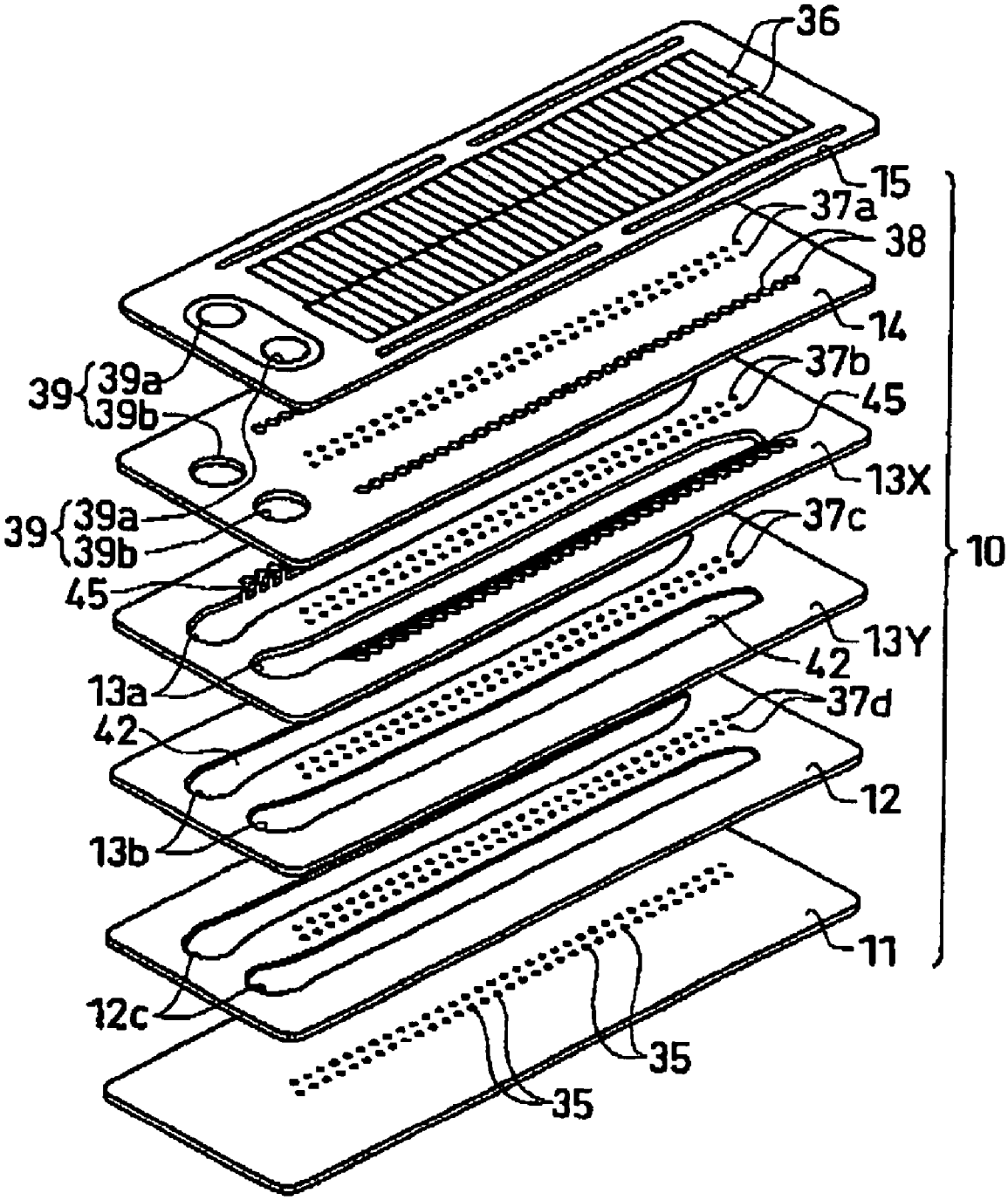
FIG. 4 is an exploded, perspective view of a channel unit of each of the recording heads.
Figure 5:
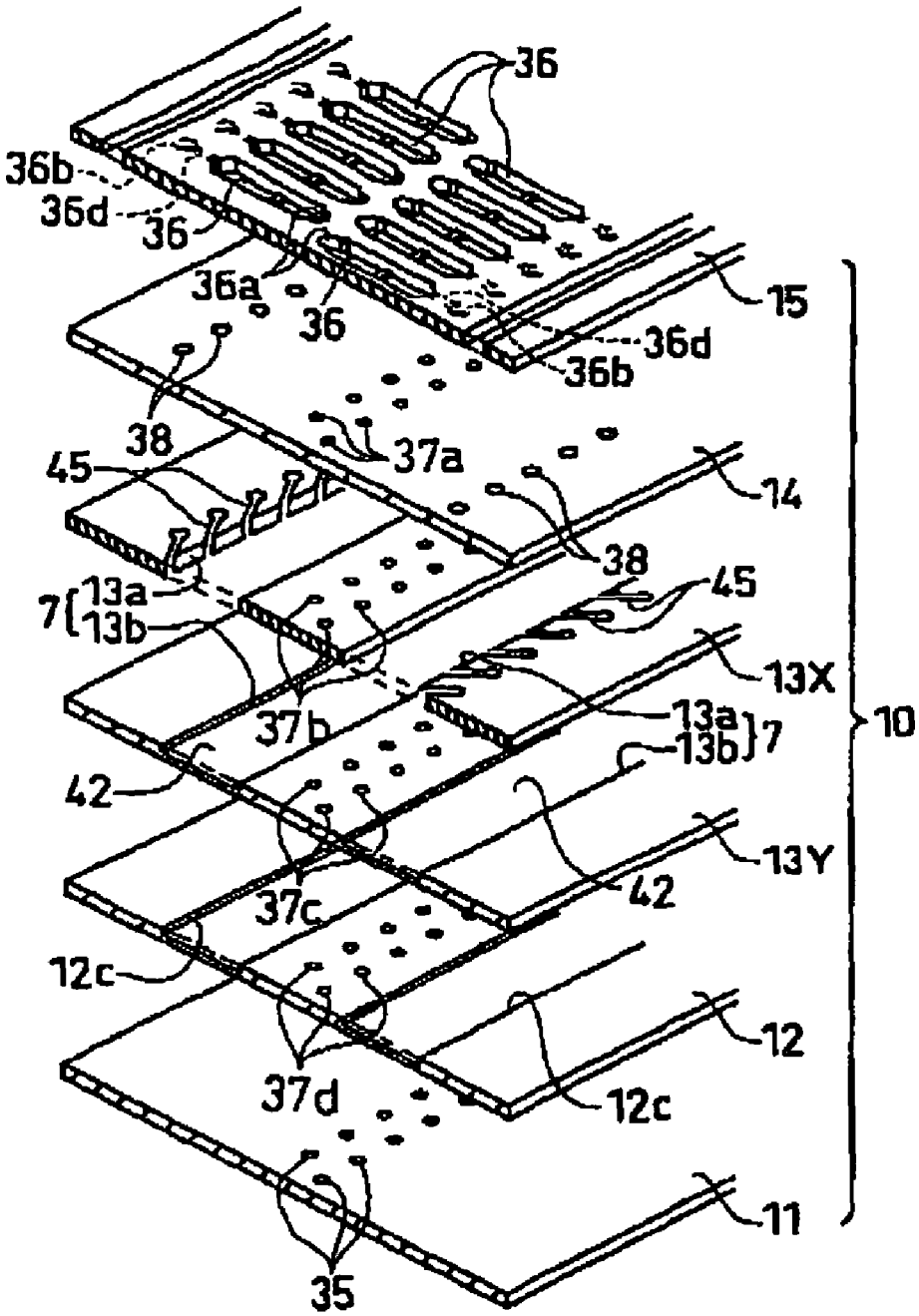
FIG. 5 is an enlarged, perspective view of a portion of the channel unit.

As shown in FIGS. 3 through 6, the channel unit 10 has a stacked structure wherein six thin metal sheets, i.e., a nozzle sheet 11, a damper sheet 12, two manifold sheets 13X, 13Y, a spacer sheet 14, and a base sheet 15 are stacked on each other and are bonded to each other As shown in FIGS. 4 and 5, the nozzle sheet 11 has a large number of nozzles 35 that are for ejecting respective droplets of ink and are arranged at regular intervals of distance, in two arrays in a zigzag or staggered fashion, in a lengthwise direction of the sheet 11. As shown in FIG. 5, the base sheet 15 has a large number of pressure chambers 36 that are arranged in two arrays in a zigzag fashion, in the lengthwise direction of the sheet 15. Each of the pressure chambers 36 has a generally rectangular flat shape, and is elongate in a direction perpendicular to the lengthwise direction of the base sheet 15. The base sheet 15 has, in a lower surface thereof opposed to the spacer sheet 14, a large number of restrictor portions 36*d* that communicate with the pressure chambers 36, respectively, and a large number of ink flow holes 36*b* that communicate with the restrictor portions 36*d*, respectively. Respective one end portions 36*a* of the pressure chambers 36 that are located in a widthwise middle portion of the base sheet 15 communicate with the nozzles 35 via respective through-holes 37*a* formed in a zigzag fashion in the spacer sheet 14, respective through-holes 37*b* formed in a zigzag fashion in the first manifold sheet 13X, respective through-holes 37*c* formed in a zigzag fashion in the second manifold sheet 13Y, and respective through-holes 37*d* formed in a zigzag fashion in the damper sheet 12.

Figure 6:
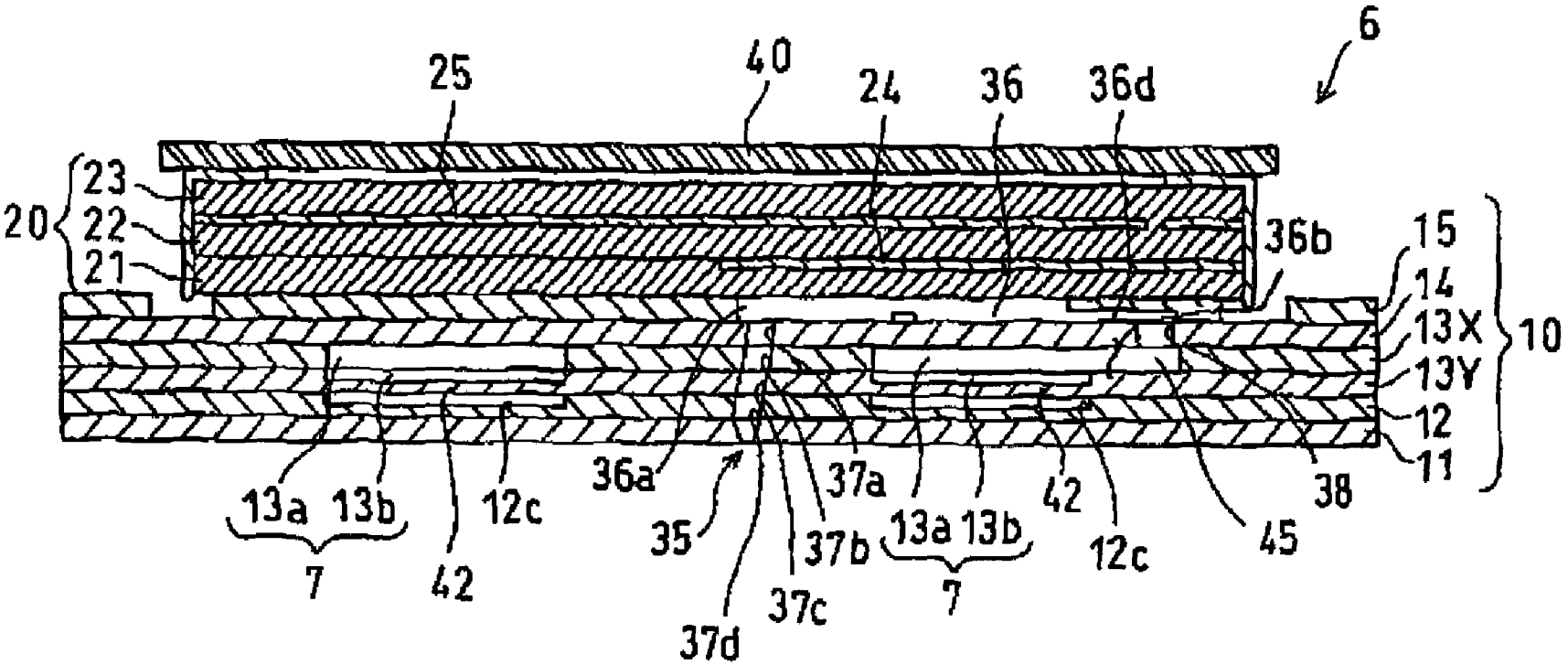
FIG. 6 is a cross-section view taken along 6-6 in FIG. 3.

As shown in FIG. 5, the first manifold sheet 13X, located on the side of the spacer sheet 14, has two half ink chambers 13*a* that are formed through a thickness of the sheet 13X. In addition, the first manifold sheet 13X has two arrays of connection portions 45 that connect the two half ink chambers 13*a* to the two arrays of ink flow holes 36*b*, respectively, via two arrays of through-holes 38 that are formed through a thickness of the spacer sheet 14. Meanwhile, the second manifold sheet 13Y, located on the side of the damper sheet 12, has two half ink chambers 13*b* that are recessed in an upper surface of the sheet 13Y such that the two half ink chambers 13*b* open toward the first manifold sheet 13X. As shown in FIG. 6, in a state in which the two manifold sheets 13X, 13Y and the spacer sheet 14 are stacked on each other, two common ink chambers 7 are defined on either side of the arrays of through-holes 37*a*, 37*b*, 37*c*.

As shown in FIG. 5, the damper sheet 12 has two damping grooves 12*c* that are recessed in an upper surface of the sheet 12 such that the two damping grooves 12*c* open toward the second manifold sheet 13Y. The two damping grooves 12*c* have, in their plan view, the same positions and shapes as those of the two common ink chambers 7, respectively. The damper sheet 12 additionally has two damping portions in the form of two diaphragms 42 that correspond to the two damping grooves 12*c*, respectively. As shown in FIG. 4, the base sheet 15 has two first ink flow inlets 39*a* corresponding the two common ink chambers 7, respectively, and the spacer sheet 14 also has two second ink flow inlets 39*b* corresponding the two common ink chambers 7, respectively. The two first ink flow inlets 39*a* communicate with the two second ink flow inlets 39*b*, respectively, and cooperate with each other to define the two ink flow inlets of the recording head 6. The spacer sheet 14 has the above-indicated two arrays of through-holes 38 on either side of the arrays of through-holes 37*a*.

Thus, the channel unit 10 has two groups of individual ink flow passages (hereinafter, referred to as the channels (Ch), as needed) each of which includes a corresponding one of the connection portions 45, a corresponding one of the through-holes 38, a corresponding one of the restrictor portions 36*d*, and a corresponding one of the pressure chambers 36, and connects a corresponding one of the two common ink chambers 7 to a corresponding one of the ink ejection nozzles 35. In the present embodiment, each of the four recording heads 6 has seventy-five channels Ch0 through Ch74, and accordingly the ink jet printer 100 has three hundred channels in total. When the actuator unit 20 applies an ejection energy to the ink present in the pressure chamber 36 of each of the 300 channels, a droplet of the ink is ejected from the nozzle 35 of the each channel Ch.

Figure 7:
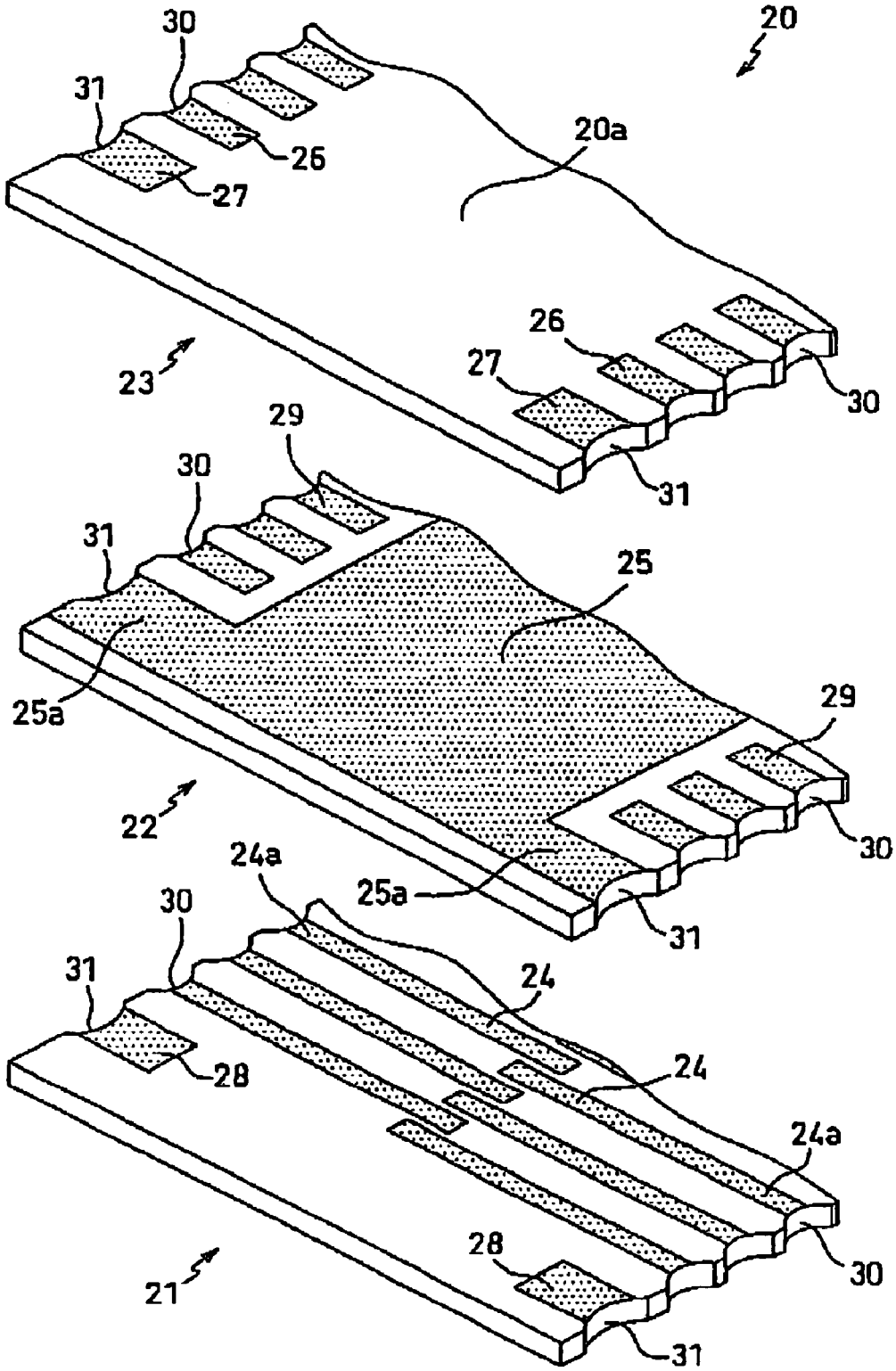
FIG. 7 is an enlarged, perspective view of a portion of an actuator unit of each of the recording heads.

Next, the actuator unit 20 will be described. As shown in FIGS. 6 and 7, the actuator unit 20 has a stacked structure wherein two piezoelectric sheets 21, 22 and one electrically insulating sheet 23 are stacked on each other. The actuator unit 20 has, on an upper surface of the first piezoelectric sheet 21, two arrays of individual electrodes 24 that correspond to the two arrays of pressure chambers 36 of the channel unit 10. As shown in FIG. 7, respective outer end portions 24*a* of the individual electrodes 24 of each of the two arrays are exposed in a corresponding one of widthwise opposite side surfaces, i.e., two long side surfaces, of the actuator unit 20.

The actuator unit 20 additionally has, on an upper surface of the second piezoelectric sheet 21, a common electrode 25 that is common to all the pressure chambers 36. Like the respective outer end portions 24*a* of the individual electrodes 24, four end portions 25*a* (only two end portions 25*a* are shown in FIG. 7) of the common electrode 25 are exposed in the two long side surfaces of the actuator unit 20. The common electrode 25 is grounded and accordingly the electric potential of the common electrode 25 is always kept at the ground potential.

The individual electrodes 24, the common electrode 25, and respective portions of the piezoelectric sheet 22 that are sandwiched by the electrodes 24, 25 cooperate with each other to provide two arrays of pressing portions that correspond to the two arrays of pressure chambers 36. The insulating layer 23 as the uppermost layer has, on an upper surface 20*a* thereof, two arrays of first external electrodes 26 that are electrically connected to the two arrays of individual electrodes 24, and four second external electrodes 27 (FIG. 3) that are electrically connected to the four end portions 25*a* of the common electrode 25, respectively.

The two piezoelectric sheets 21, 22 and the insulating sheet 23 have, on their two long side surfaces thereof, first grooves 30 that correspond to the respective outer end portions of the individual electrodes 24, and extend in the direction of stacking of the sheets 21, 22, 23; and second grooves 31 that correspond to the respective end portions 25*a* of the common electrodes 24, and extend in the direction of stacking of the sheets 21, 22, 23. Each of the first grooves 30 supports an external electrode, not shown, that electrically connects a corresponding one of the individual electrodes 24 to a corresponding one of the external electrodes 26; and each of the second grooves 31 supports an external electrode, not shown, that electrically connects a corresponding one of the end portions 25*a* of the common electrode 25 to a corresponding one of the external electrodes 27. In FIG. 7, reference numerals 28 designate dummy common electrodes, and reference numerals 29 designate dummy individual electrodes.

The actuator unit 20 is stacked on the channel unit 10 such that the individual electrodes 24 of the actuator unit 20 are aligned with the pressure chambers 36 of the channel unit 10, respectively. In addition, the flexible flat cable 40 is electrically bonded to the external electrodes 26, 27 provided on the upper surface 20*a* of the actuator unit 20. Thus, the individual and external electrodes 24, 26 corresponding to the pressure chambers 36 cooperate with the common and external electrodes 25, 27 and the piezoelectric sheets 21, 22 to constitute two arrays of piezoelectric actuators that actuate the two arrays of pressure chambers 36 and thereby eject respective droplets of ink from the two arrays of nozzles 35.

When the present ink jet printer 100 is started, an electric voltage is applied to each of the individual electrodes 24 and the common electrode 25 via a corresponding one of the external electrodes 26 and the external electrodes 27, so that a portion of the piezoelectric sheet 22 that is opposed to the one individual electrode 24 having a positive electric potential is strained or deformed, because of a piezoelectric effect, in the direction of stacking of the layers 21, 22, 23, so that that portion of the piezoelectric sheet 22 is convexly swollen into a corresponding one of the pressure chambers 36 and accordingly a volume of the one pressure chamber 36 is decreased. This state will be referred to as the "stand-by state" of each individual electrode 24 or each pressure chamber 36. From this stand-by state, the electric potential of each individual electrode 24 is lowered once to the ground potential, and subsequently the electric potential of the each individual electrode 24 is increased again to the positive potential so as to eject a droplet of ink from the corresponding nozzle 35.

Figure 9:
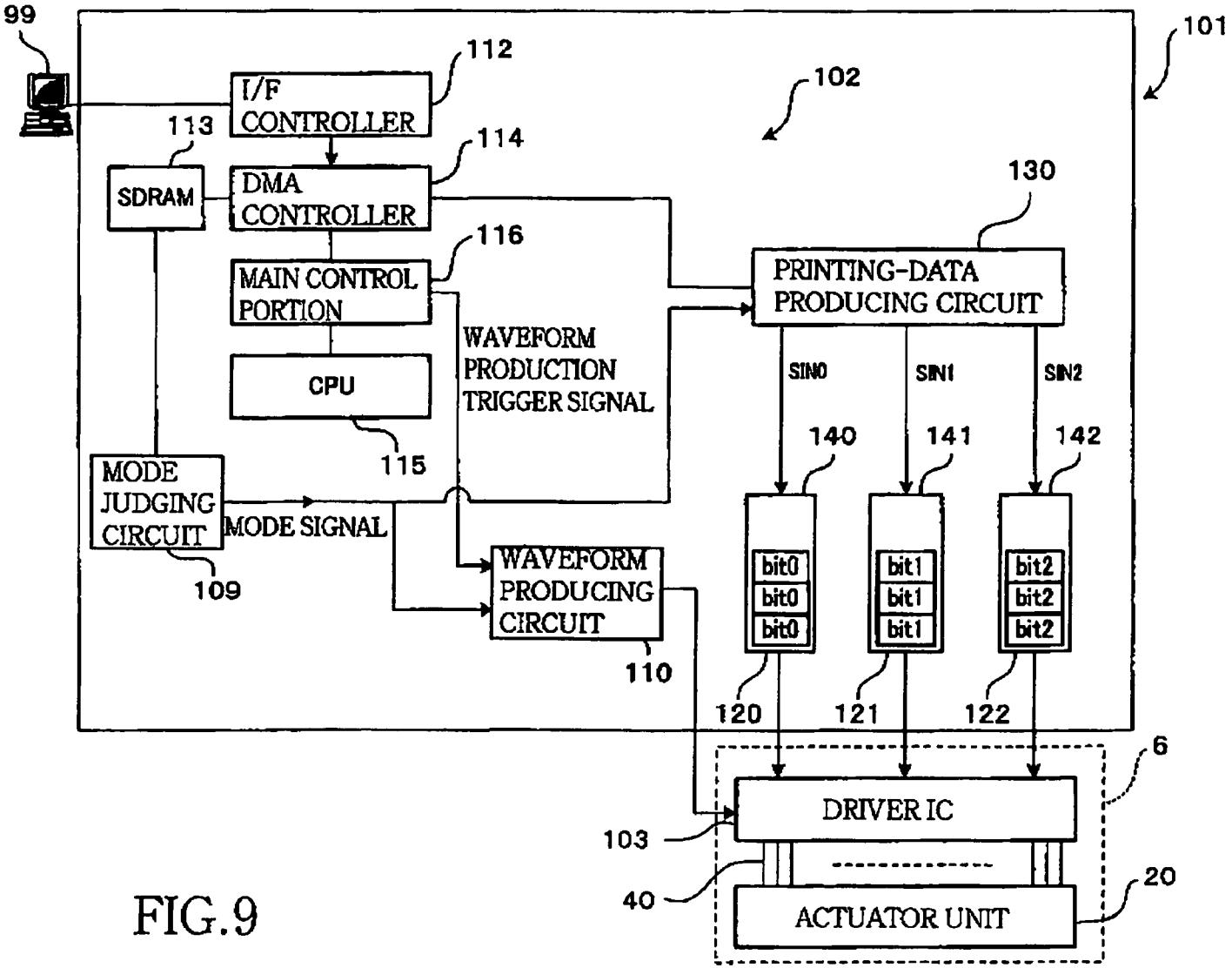
FIG. 9 is a diagrammatic view of the control device.

Next, an arrangement of an electric circuit of the ink jet printer 100 that relates to the function of ejecting droplets of ink or inks will be described by reference to FIGS. 8 through 10, 11A through 11H, 12 through 14, and 15A through 15H. As shown in FIGS. 8 and 9, the ink jet printer 100 employs a control device 101 including a main circuit 102 that is electrically connected via signal lines 120, 121, 122, etc to each of the four driver ICs 103 that drive the four recording heads 6, respectively. As described above, the four driver ICs 103 are electrically connected to the respective actuator units 20 of the four recording heads 6 via the respective flexible flat cables 40. The control device 101 and the driver ICs 103 cooperate with each other to constitute a driving apparatus or device for driving the ink jet recording device. However, it can be said that the driver ICs 103 constitute the driving apparatus or device.

Thus, in the present ink jet printer 100, the single control device 101 is connected to the four driver ICs 103 and the four actuator units 20. However, FIGS. 8 and 9 show only one driver IC 103 and only one actuator unit 20 for easier understanding purposes only.

As shown in FIG. 9, the control device 101 receives, from an external device 99 such as a personal computer, image data representing an image to be recorded or printed, via an I/F (interface) controller 112. The image data has, for each of the four color inks, the same number of picture elements as the number of printing dots (i.e., the nozzles 35) of each recording head 6, and each picture element is constituted by two bits (i.e., two sets of bit data). Thus, the image data are given as bit map data. As will be described later, two bits constituting each picture element define, regarding the number of drop(s) of ink, i.e., the amount of ink, ejected from the corresponding nozzle 35 in each recording cycle, zero (i.e., no) drop of ink, one drop of ink, two drops of ink, or three drops of ink, i.e., no amount of ink, a small amount of ink, a medium amount of ink, or a large amount of ink.

The image data received by the control device 101 are stored in an SDRAM (synchronous direct random access memory) 113 by a DMA (direct memory access) controller 114 that is controlled by a main control portion 116 connected to a CPU 115. A mode judging circuit 109 is connected to the SDRAM 113. The mode judging circuit 109 judges, based on a head portion of the image data stored in the SDRAM 113, whether the image data are monochromatic image data or fill-color image data, and outputs a mode signal representing a result of this judgment, i.e., indicating that the image data are monochromatic image data or that the image data are full-color image data.

The main circuit 102 of the control device 101 includes, in addition to the above-described I/F controller 112, the DMA controller 114, the SDRAM 113, the CPU 115, the main control portion 116, and the mode judging circuit 109, a waveform producing circuit 110, four printing-data producing circuits 130 (only one printing-data producing circuit 130 is shown), and three transfer buffers 140, 141, 142 provided between the printing-data producing circuit 130 and the driver IC 103.

The waveform producing circuit 110 produces a plurality of sorts of ejection signals that have different waveforms and can be supplied to the individual electrode 24 of each piezoelectric actuator; a stand-by signal that is supplied to the individual electrode 24 so as to make the same 24 have a positive potential; and a stand-by cancel signal (i.e., a pause signal) that is supplied to the individual electrode 24 so as to make the same 24 have the ground potential.

Figure 10:
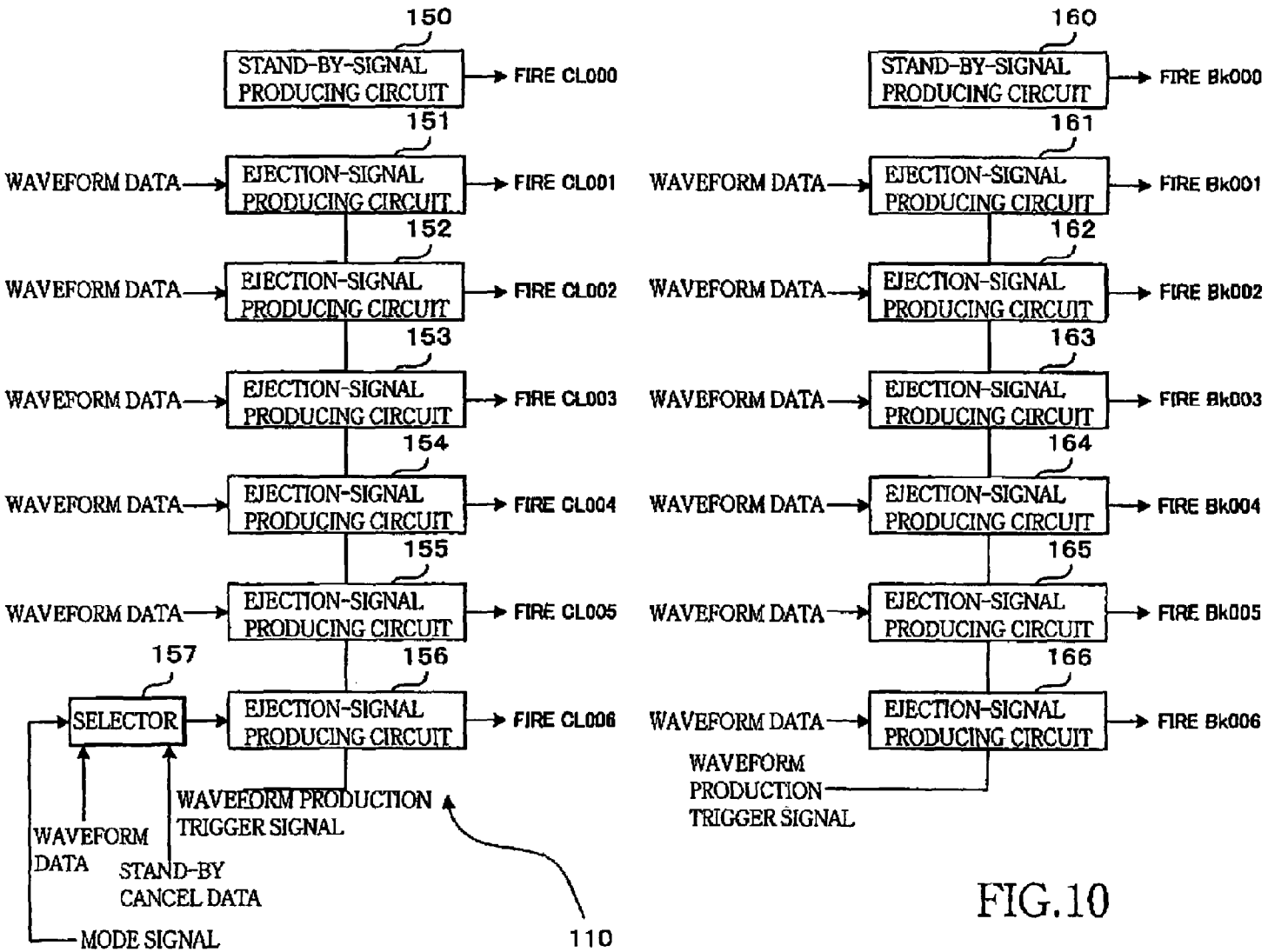
FIG. 10 is a diagrammatic view of a waveform producing circuit of the control device.
Figure 11A:
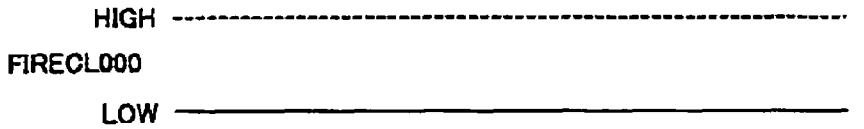
FIGS. 11A, 11B, 11C, 11D, 11E, 11F, 11G, and 11H are graphs showing respective waveforms of signals produced by the waveform producing circuit.

FIG. 10 is a diagrammatic view showing, in detail, a construction of the waveform producing circuit 110. The waveform producing circuit 110 includes a first circuit that produces signals corresponding to the three chromatic color inks, i.e., the cyan, magenta, and yellow inks, and a second circuit that produces signals corresponding to the monochromatic color ink, i.e., the black ink. The first circuit includes a stand-by-signal producing circuit 150 that produces a stand-by signal FIRE CL000 whose waveform is shown in FIG. 11A; six ejection-signal producing circuits 151, 152, 153, 154, 155, 156 that produce six ejection signals FIRE CL001 (FIG. 11B), FIRE CL002 (FIG. 11C), FIRE CL003 (FIG. 11D), FIRE CL004 (FIG. 11E), FIRE CL005 (FIG. 11F), FIRE CL006 (FIG. 11G), respectively; and a selector 157. The second circuit includes a stand-by-signal producing circuit 160 that produces a stand-by signal FIRE Bk000; and six ejection-signal producing circuits 161, 162, 163, 164, 165, 166 that produce six ejection signals FIRE Bk001, FIRE Bk002, FIRE Bk003, FIRE Bk004, FIRE Bk005, FIRE Bk006, respectively.

As will be described later, the signals outputted by the stand-by-signal producing circuits 150, 160 and the ejection-signal producing circuits 151 through 156, 161 through 166 will be inverted by the driver IC 103. When each of the ejection-signal producing circuits 151 through 156, 161 through 166 receives a waveform production trigger signal from the main control portion 116, the each producing circuit produces an ejection signal, or a stand-by cancel signal, as will be described below.

FIG. 11A shows a waveform of the stand-by signal FIRE CL000 outputted by the stand-by-signal producing circuit 150. As is apparent from this figure, the stand-by signal FIRE CL000 constantly takes a low-level electric potential when being outputted from the producing circuit 150. At this stage, a difference of the low-level potential and a high-level potential is not so large, and this difference will be amplified later. The stand-by signal FIRE Bk000 outputted by the stand-by-signal producing circuit 160 has the same waveform as that shown in FIG. 11A.

Figure 11B:
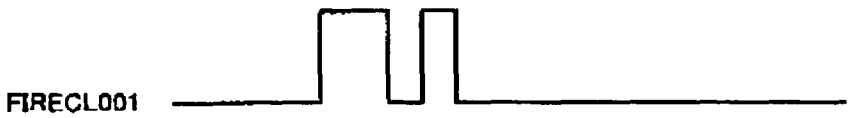
Figure 11C:
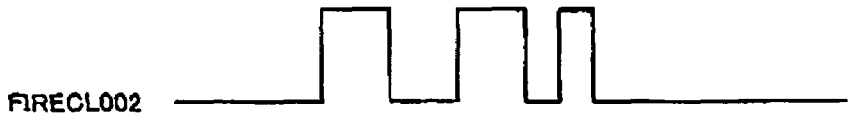
Figure 11D:
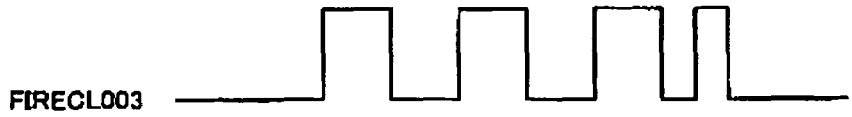

The ejection-signal producing circuits 151 through 156 receive different waveform data, respectively, from the main control portion 116. FIG. 11B shows a waveform of the ejection signal FIRE CL001 outputted by the ejection-signal producing circuit 151. As is apparent from this figure, the ejection signal FIRE CL001 is a pulse-train signal including two pulses. The first one (i.e., ink-ejection pulse) of the two pulses is for ejecting a droplet of ink from the nozzle 35, and the second pulse is for attenuating a pressure wave remaining in the corresponding ink channel. FIGS. 11C and 11D show respective waveforms of the ejection signals FIRE CL002, FIRE CL003 outputted by the ejection-signal producing circuits 152, 153. The ejection signals FIRE CL002, FIRE CL003 are pulse-train signals including three and four pulses, respectively, that are more by one or two pulses than the pulses of the ejection signal FIRE CL001Y That is, when the ejection signal FIRE CL002 is supplied to each of the piezoelectric actuators corresponding to the cyan, magenta, and yellow inks, the corresponding nozzle 35 ejects two drops of ink; and when the ejection signal FIRE CL002 is supplied to the each actuator, the corresponding nozzle 35 ejects three drops of ink.

Thus, the waveform producing circuit 110 can produce three sorts of ejection signals to eject different numbers of drops of ink. The plurality of drops of ink, successively ejected from the same nozzle 35, can be controlled such that those ink droplets are integrated with each other before they reach the recording sheet 62, or such that those ink droplets reach the same position on the sheet 62, so that in each case the ink droplets form a single dot on the sheet 62. Thus, based on the different sorts of ejection signals defined by the two bits (i.e., the two sets of bit data) constituting each picture element of the image to be recorded, the present ink jet printer 100 can print an image by area coverage modulation.

Figure 11E:
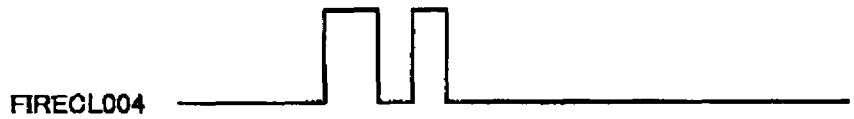
Figure 11F:
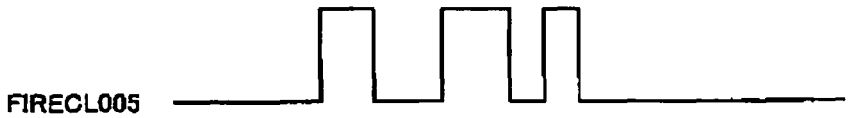
Figure 11G:
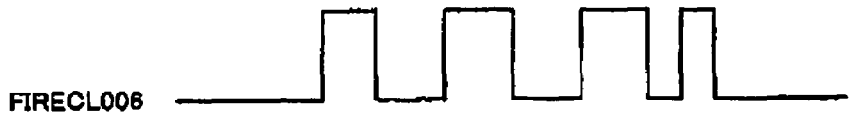

FIGS. 11E, 11F, and 11G show respective waveforms of the ejection signals FIRE CL004, FIRE CL005, FIRE CL006 outputted by the ejection-signal producing circuits 154, 155, 156, respectively. The ejection signals FIRE CL004, PIRE CL005, FIRE CL006 have basically the same waveforms as those of the ejection signals FIRE CL001, FIRE CL002, FIRE CL003, respectively, except that the first pulse of each of the ejection signals FIRE CL004, FIRE CL005, FIRE CL006 has a width somewhat smaller than that of a corresponding one of the ejection signals FIRE CL001, FIRE CL002, FIRE CL003. Therefore, when each of the ejection signals FIRE CL004, FIRE CLODS, FIRE CL006 is supplied to each of the piezoelectric actuators corresponding to the cyan, magenta, and yellow inks, the corresponding nozzle 35 ejects one, two, or three drops of ink. According to an operation-history control based on the preceding manner of ejection of ink, each of the ejection signals FIRE CL004, FIRE CL005, FIRE CL006 may be used in place of a corresponding one of the ejection signals FIRE CL001, FIRE CL002, FIRE CL003, for the purpose of improving the printing quality. Respective waveforms of the ejection signals FIRE Bk001, FIRE Bk002, FIRE Bk003, FIRE Bk004, FIRE Bk006, FIRE Bk006 outputted by the ejection-signal producing circuits 161, 162, 163, 164, 165, 166, respectively, are not shown. The reason why the ejection signals corresponding to the chromatic inks such as the yellow ink are produced separately from the ejection signals corresponding to the black ink, or vice versa, is that the chromatic inks have different ejection characteristics than those of the black ink, or vice versa.

The selector 157 receives the waveform data, and stand-by cancel data, from the main control portion 116. In the case where the mode signal outputted by the mode judging circuit 109 indicates a full-color print mode, i.e., that the image data are full-color image data, the selector 157 selects the waveform data, and outputs the waveform data to the ejection-signal producing circuit 156 corresponding to the chromatic inks; and in the case where the mode signal indicates a monochromatic print mode, i.e., that the image data are monochromatic image data, the selector 157 selects the stand-by cancel data, and outputs the stand-by cancel data to the ejection-signal producing circuit 156. Thus, when the mode signal indicates the full-color print mode, the ejection-signal producing circuit 156 produces the ejection signal FIRE CL006 shown in FIG. 11G; and when the mode signal indicates the monochromatic print mode, the ejection-signal producing circuit 156 produces the stand-by cancel signal FIRE CL006 shown in FIG. 11H. As is apparent from this figure, the stand-by cancel signal FIRE CL006 constantly takes the high-level potential when being outputted from the ejection-signal producing circuit 156. Thus, the selector 157 selects, based on the mode signal received from the mode judging circuit 109, the signal to be outputted from the waveform producing circuit 110. The selector 157 cooperates with the ejection-signal producing circuit 156 to constitute a pause-signal producer.

The printing-data producing circuit 130 produces, based on the image data stored by the SDRAM 113 and the mode signal received from the mode judging circuit 109, serial printing data (i.e., three printing signals SIN0, SIN1, SIN2) that are constituted by three bits (i.e., three sets of bit data) bit0, bit1, bit2. The three printing signals SIN0, SIN1, SIN2 are supplied to the three transfer buffers 140, 141, 142, respectively. As shown in FIG. 9, the fist bit bit0 corresponds to the first transfer buffer 140; the second bit bit1 corresponds to the second transfer buffer 141; and the third bit bit2 corresponds to the third transfer buffer 142. The three printing signals SIN0, SIN1, SIEN2 are used to select one of the seven signals FIRE CL000 through FIRE CL006, or one of the seven signals FIRE Bk000 through FIRE Bk006, produced by the waveform producing circuit 110.

Here, a relationship between the three printing signals SIN0, SIN1, SIN2 and the seven signals FIRE CL000 through FIRE CL006, or the seven signals FIRE Bk000 through FIRE Bk006, produced by the waveform producing circuit 110 will be explained by reference to FIG. 12. As shown in this figure, each one of the three printing signals SIN0, SIN1, SIN2 can selectively take a high-level and a low-level potential, independent of the other two printing signals. Thus, the three printing signals SIN0, SIN1, SIN2 cooperate with each other to define eight different combinations designating eight different signals, respectively, For example, when the three printing signals SIN0, SIN1, SIN2 take the low-level potential as indicated at (a), the three printing signals SIN0, SIN1, SIN2 designate the stand-by signal FIRE CL000 or FIRE Bk000; and when the printing signal SIN0 takes the high-level potential and the other two printing signals SIN1, SIN2 take the low-level potential as indicated at (b), the three printing signals SIN0, SIN1, SIN2 designate the ejection signal FIRE CL001 or FIRE Bk001. Likewise, when the three printing signals SIN0, SIN1, SIN2 take the respective high-level or low-level potentials as indicated at each of (c), (d), (e), (f), and (g), the three printing signals SIN0, SIN1, SIN2 designate a corresponding one of the ejection signals FIRE CL002 or FIRE Bk002, FIRE CL003 or FIRE Bk003, FIRE CL004 or FIRE Bk004, FIRE CL005 or FIRE Bk005, and FIRE CL006 or FIRE Bk006. In the present embodiment, however, the three printing signals SIN0, SIN1, SIN2 are not controlled to take simultaneously the high-level potential as indicated at (h). However, in a second embodiment described later, the printing signals SIN0, SIN1, SIN2 can be controlled in that manner.

Figure 12:
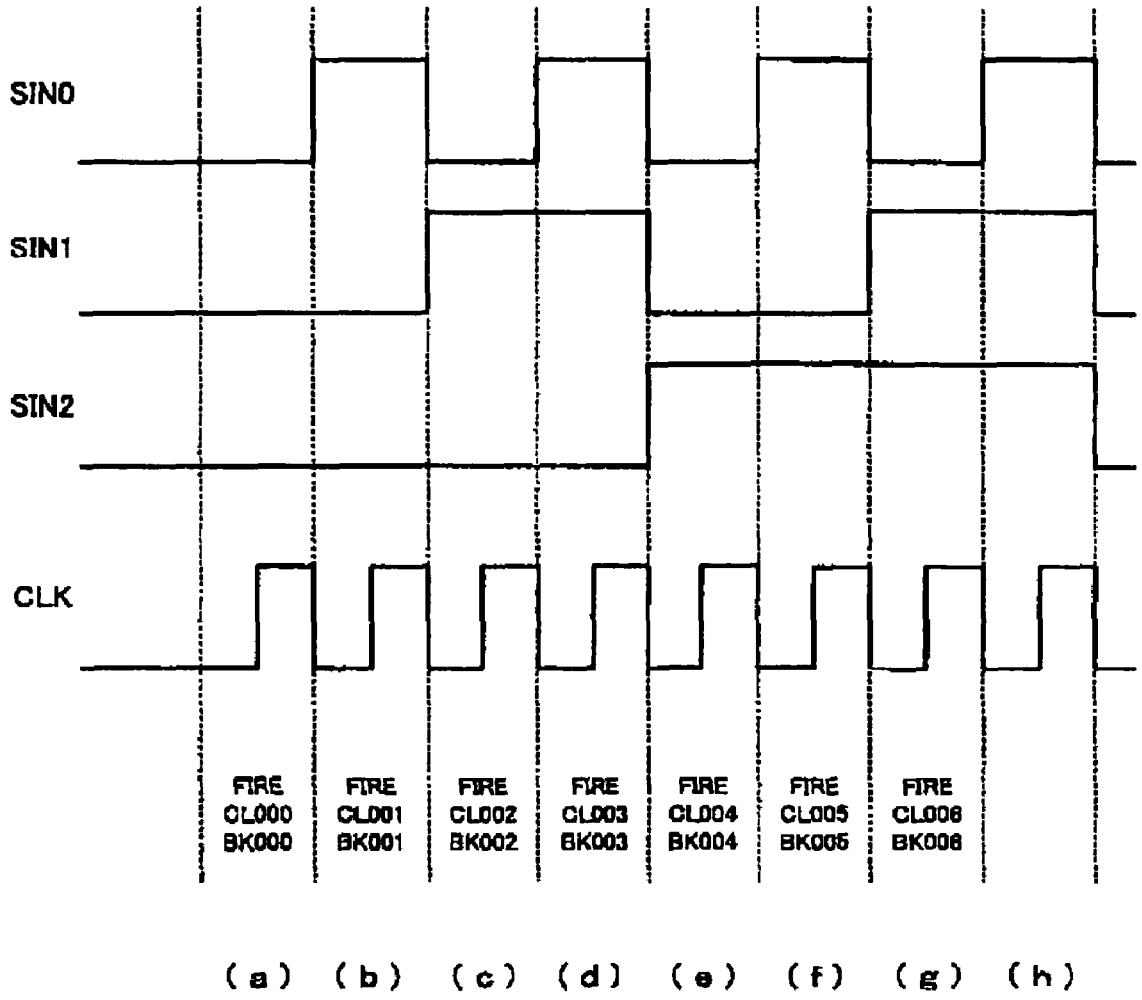
FIG. 12 is a graph showing respective waveforms of three signals as printing data produced by a printing-data producing circuit of the control device.

In the present embodiment, when the ink jet printer 100 carries out a printing operation in the full-color print mode, the printing data producing circuit 130 produces, for one or more individual electrodes 24 corresponding to one or more operative nozzles 35 that are to eject ink, the three printing signals SIN0, SIN1, SIN2 having the respective high-level or low-level potentials indicated at an appropriate one of (b) through (g) in FIG. 12 that corresponds to a desired amount of ink, and produces, for one or more individual electrodes 24 corresponding to one or more stand-by nozzles 35 that are not to eject ink, the three printing signals SIN0, SIN1, SIN2 having the respective low-level potentials indicated at (a). Thus, irrespective of the plurality of sorts of inks used, each piezoelectric actuator can be smoothly changed between an ejection preparing state thereof in which the each actuator is convexly swollen into the corresponding pressure chamber 36 without ejecting ink, and an ink ejecting state thereof in which the each actuator is continuously deformed to eject ink, and accordingly each operative nozzle 35 can eject an appropriate amount of ink at an appropriate timing.

In addition, when the present ink jet printer 100 carries out a printing operation in the monochromatic print mode, the printing data producing circuit 130 produces, for one or more individual electrodes 24 corresponding to one or more operative nozzles 35 (of the black-ink ejecting head 6) that are to eject ink, the three printing signals SIN0, SIN1, SIN2 having the respective high-level or low-level potentials indicated at an appropriate one of (b) through (g) in FIG. 12 that corresponds to a desired amount of ink, and produces, for one or more individual electrodes 24 corresponding to one or more stand-by nozzles 35 that are not to eject ink, the three printing signals SIN0, SIN1, SIN2 having the respective low-level potentials indicated at (a). In addition, the printing data producing circuit 130 produces, for each of the individual electrodes 24 corresponding to the nozzles 35 of the cyan-ink, magenta-ink, and yellow-ink ejecting heads 6, the three printing signals SIN0, SIN1, SIN2 having the respective high-level or low-level potentials indicated at (g) in FIG. 12. Thus, regarding the black-ink ejecting head 6, each piezoelectric actuator can be smoothly changed between an ejection preparing state thereof in which the each actuator is convexly swollen into the corresponding pressure chamber 36 without ejecting ink, and an ink ejecting state thereof in which the each actuator is continuously deformed to eject ink, and accordingly each operative nozzle 35 can eject an appropriate amount of ink at an appropriate timing; and regarding the cyan-ink, magenta-ink, and yellow-ink ejecting heads 6, no electric voltage is applied to any of the piezoelectric actuators, that is, an electric voltage having 0 V is applied to each actuator.

The three transfer buffers 140, 141, 142 are connected to the three signal lines 120, 121, 122, respectively, and transfer the three printing signals SIN0, SIN1, SIN2 received from the printing data producing circuit 130, to the driver IC 103 via the three signal lines 120, 121, 122, respectively.

Figure 13:
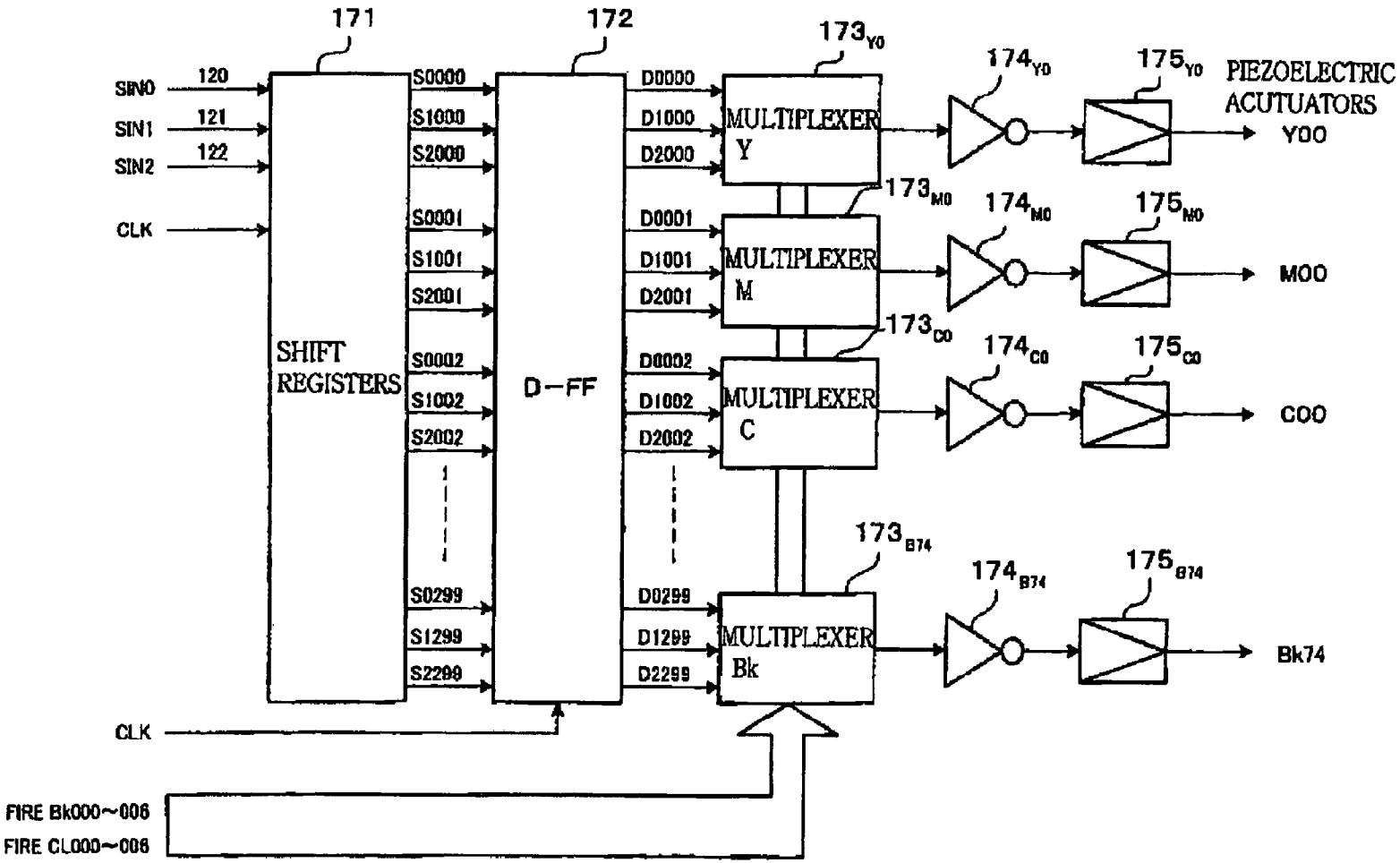
FIG. 13 is a diagrammatic view of one of respective driver ICs corresponding to the recording heads.

The main circuit 102 of the control device 101 produces a transfer clock CLK, and sends it to the driver IC 103. However, since the transfer clock CLK is known in the art, it is not described here Next, the driver IC 103 will be described in detail. FIG. 13 is a diagrammatic view of the four driver ICs 103 that are integrated with each other for easier understanding purposes only.

As shown in FIG. 13, the driver ICs 103 include shift registers 171 as serial-parallel converters; D-flip-flops (D-FF) 172 as latch circuits; three-hundred (300) multiplexers 173Y0, 173M0, 173C0, . . . , 173B74; three-hundred (300) logic inverter circuits 174Y0, 174M0, 174C0, . . . , 174B74; and three-hundred (300) power amplifier circuits 175Y0, 175M0, 175C0, . . . , 175B74. Each of the shift registers 171 converts three-bit serial printing data (three printing signals) SIN0, SIN1, SIN2 supplied thereto, into parallel printing data. Each of the multiplexers 173 selects, based on the parallel printing data supplied thereto, one of the seven signals FIRE CL000 through FIRE CL006, or the seven signals FIRE Bk000 through FIRE Bk006, produced by the waveform producing circuit 110.

The shift registers 171 receive, at a timing when the transfer clock CLK rises, three-hundred (300) sets of three-bit serial printing data SIN0, SIN1, SIN2 corresponding to the three-hundred (300) channels of the four recording heads 6, via the signal lines 120, 121, 122. The shift registers 171 corresponding to each of the four driver ICs 103 or the four recording heads 6 have a bit length equal to two-hundred-and-twenty-five (225) bits (=75 (the number of channels)×3 (the number of bits constituting serial printing data SIN0, SIN1, SIN2 corresponding to each channel). The shift registers 171 sequentially output the parallel printing signals to each of the 300 channels. For example, in FIG. 13, symbols S0000, S1000, S2000 indicate parallel printing signals corresponding to the zero-th channel of the yellow-ink recording head 6; symbols S0001, S1001, S2001 indicate parallel printing signals corresponding to the zero-th channel of the magenta-ink recording head 6; symbols S0002, S1002, S2002 indicate parallel printing signals corresponding to the zero-th channel of the cyan-ink recording head 6; and symbols S0299, S1200, S2299 indicate parallel printing signals corresponding to the seventy-fourth channel of the black-ink recording head 6. The shift registers 171 sequentially output, for each of the 300 channels, the parallel printing signals to the D-flip-flops 172. The shift registers 171 of the driver ICs 103 constitute a signal-and-data obtainer. However, it can be said that the printing-data producing circuit 130 constitutes the signal-and-data obtainer.

The D-flip-flops 172 simultaneously output, according to the transfer clock CLK received from the main circuit 102, the three-hundred sets of parallel printing signals to the three-hundred multiplexers 173Y0, 173M0, 173C0, . . . , 173B74, respectively. In FIG. 13, the signals outputted from the D-flip-flops 172 are indicated by "D" such as D0000, D1000, D2299. However, the signals outputted from the D-flip-flops 172 are identical with the signals inputted to the D-flip-flops 172.

Each of the two-hundred-and-twenty-five multiplexers 173Y0, 173M0, 173C0, . . . , 173Y74, 173M74, 173C74 corresponding to the yellow-ink, magenta-ink, and cyan-ink recording heads 6, receives the seven signals FIRE CL000 through FIRE CL006 produced by the waveform producing circuit 110. As described above, the signal FIRE CL006 can selectively take the waveform as the ejection signal, shown in FIG. 11G, or the waveform as the stand-by-cancel signal, shown in FIG. 11H, depending upon whether the mode signal indicates the full-color print mode or the monochromatic print mode. Meanwhile, each of the seventy-five multiplexers 173B0, . . . , 173B74 corresponding to the black-ink recording head 6 receives the seven signals FIRE Bk000 through FIRE Bk006 produced by the waveform producing circuit 110. In addition, the three-hundred multiplexers 173Y0, 173M0, 173C0, . . . , 173B74 additionally receive the respective sets of parallel printing signals D0000, D1000, D2000, . . . , D0299, D1299, D2299 each as a selecting signal to select one of the seven signals FIRE CL000 through FIRE CL006, or the seven signals FIRE Bk000 through FIRE Bk006, produced by the waveform producing circuit 110.

Each of the multiplexers 173Y0, 173M0, 173C0, 173B74 selects, based on the printing data produced by the printing-data producing circuit 130, one of the seven signals FIRE CL000 through FIRE CL006, or the seven signals FIRE Bk000 through FIRE Bk006, produced by the waveform producing circuit 110, and outputs the selected signal. FIG. 14 shows a manner in which each multiplexer 173 selects one signal FIRE CL000 through FIRE CL006, or FIRE Bk000 through FIRE Bk006. As shown in FIG. 14, when the mode signal indicates the full-color print mode, the multiplexers 173 corresponding to the yellow-ink, magenta-ink, and cyan-ink recording heads 6 select, for one or more operative nozzles 35 that are currently commanded to eject ink, one of the ejection signals FIRE CL001 through FIRE CL006 that corresponds to a desired amount of ink and an ejection history and select, for one or more stand-by nozzles 35 that are currently commanded to stand by, i.e., not to eject ink, the stand-by signal FIRE CL000. Meanwhile, the multiplexers 173 corresponding to the black-ink recording head 6 select, for one or more operative nozzles 35 that are currently commanded to eject ink, one of the ejection signals FIRE Bk001 through FIRE Bk006 that corresponds to a desired amount of ink and an ejection history and select, for one or more stand-by nozzles 36 that are currently commanded to stand by, i.e., not to eject ink, the stand-by signal FIRE Bk000.

When the mode signal indicates the monochromatic print mode, the multiplexers 173 corresponding to the black-ink recording head 6 select, for one or more operative nozzles 35 that are currently commanded to eject ink, one of the ejection signals FIRE Bk001 through FIRE Bk006 that corresponds to a desired amount of ink and an ejection history and select, for one or more stand-by nozzles 35 that are currently commanded to stand by, i.e., not to eject ink, the stand-by signal FIRE Bk000. Meanwhile, the multiplexers 173 corresponding to the yellow-ink, magenta-ink, and cyan-ink recording heads 6 select, for all the nozzles 35) the stand-by cancel signal FIRE CL006 shown in FIG. 11H. The three-hundred multiplexers 173 constitute a signal selector or a voltage applier. However, it can be said that the waveform producing circuit 110 and the multiplexers 173 cooperate with each other to constitute the voltage applier.

The three-hundred logic inverter circuits 174Y0, 174M0, 174C0, . . . , 174B74 invert the respective signals supplied from the three-hundred multiplexers 173Y0, 173M0, 173C0, . . . 173B74. Thus, the signals FIRE CL000 through FIRE CL006 having the respective waveforms shown in FIGS. 11A through 11H are inverted into the signals FIRE CL000 through FIRE CL006 having respective waveforms shown in FIGS. 15A through 15H.

The three-hundred power amplifier circuits 175Y0, 175M0, 175C0, . . . , 175B74 amplify the high-level potential of the respective signals supplied from the three-hundred logic inverter circuits 174Y0, 174M0, 174C0, . . . , 174B74, so that the respective amplified signals have an appropriate high-level voltage. The respective amplified signals are supplied, via respective electric wires of the four flexible flat cables 40, the respective individual electrodes 24 of the four recording heads 6.

Figure 15A:
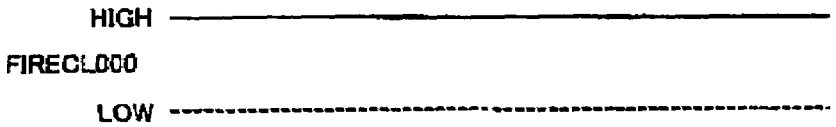
FIGS. 15A, 15B, 15C, 15D, 15E, 15E, 15F, 15G, and 15H are graphs showing respective waveforms of signals obtained by inverting the respective waveforms of the signals shown in FIGS. 11A through 11H.
Figure 15B:
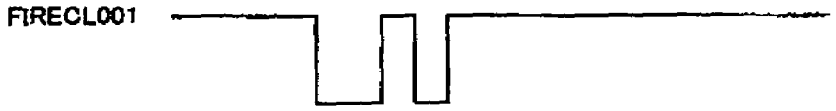
Figure 15C:
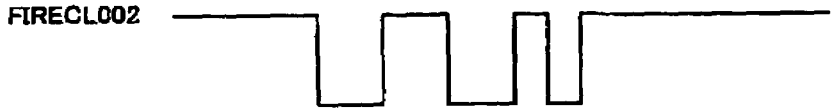
Figure 15D:
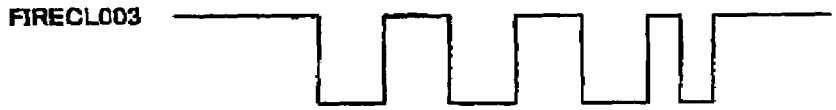
Figure 15E:
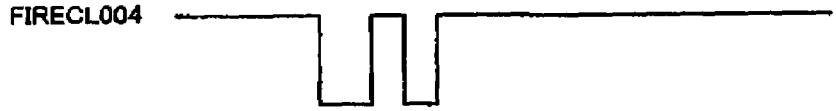
Figure 15F:
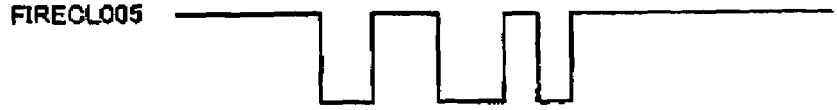
Figure 15G:
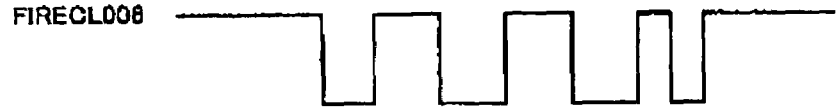
Figure 15H:
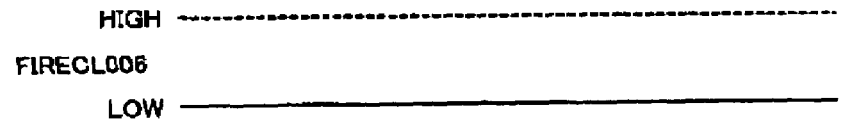

As shown in FIG. 15H, the stand-by cancel signal that can be supplied to each of the individual electrodes 24 constantly takes the low-level potential that is, in the present embodiment, equal to the earth potential. Meanwhile, the common electrode 25 is constantly kept at the earth potential, irrespective of which is the current print mode, the full-color print mode or the monochromatic print mode. Thus, in the monochromatic print mode, each of the piezoelectric actuators corresponding to the yellow, magenta, and cyan inks is placed in a state in which no electric voltage is applied to a corresponding one of the individual electrodes 24, and the common electrode 25. Therefore, regarding each of the piezoelectric actuators corresponding to the yellow-ink, magenta-ink, and cyan-ink recording heads 6 of the present ink jet printer 100, a time period in which the each actuator is placed in a state in which an electric voltage not equal to 0 V is applied to a corresponding one of the individual electrodes 24, and the common electrode 26 can be decreased as compared with the previously-described conventional piezoelectric actuators. Thus, the present ink jet printer 100 is freed of the problem that an electric short-circuit occurs because of the phenomenon of "migration".

Since, in the present embodiment, the printing data producing circuit 130 produces the serial printing data SIN0, SIN1, SIN2, based on the image data and the mode signal, the multiplexers 173 receives not a combination of the image data and the mode signal, but just the printing data. Therefore, the present ink jet printer 100 can employ a simplified wiring structure or network, Moreover, in the present embodiment, each driver IC 103 includes the shift registers 171 as the serial-parallel converters, and the D-flip-flops 172 as the latch circuits. Thus, the control device 101 and each driver IC 103 can be connected to each other via the serial signal lines 120, 121, 122. Thus, the total number of signal lines can be largely decreased. This also leads to simplifying the wiring network.

Figure 11H:
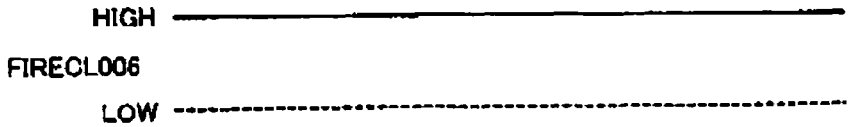

In addition, in the present embodiment, the waveform producing circuit 110 includes the selector 157, and the ejection-signal producing circuit 156 selectively produces the ejection signal shown in FIG. 11G or the stand-by cancel signal shown in FIG. 11H. This leads to decreasing the total number of signals from which each multiplexer 173 selects one signal. Therefore, the total number of wires can be decreased, the wiring network can be simplified, and accordingly the ink jet printer 100 or the driving apparatus or device thereof can enjoy a decreased production cost.

Moreover, in the present embodiment, all the pulse signals supplied to the piezoelectric actuators of the four recording heads 6 can selectively take only the two voltage levels, i.e., the low-level and high-level voltages, and the low-level voltage is equal to the earth potential and the high-level voltage is equal to the pre-determined positive potential. Thus, the piezoelectric actuators can be easily controlled.

Next, there will be described a second embodiment of the present invention by reference to FIG. 16. Since the second embodiment also relates to an ink jet printer and is basically identical with the ink jet printer 100 as the first embodiment, only differences of the second embodiment from the first embodiment will be described below. The same reference numerals as used in the first embodiment are used to designate the corresponding elements or portions of the second embodiment, and the description thereof is omitted.

Figure 16:
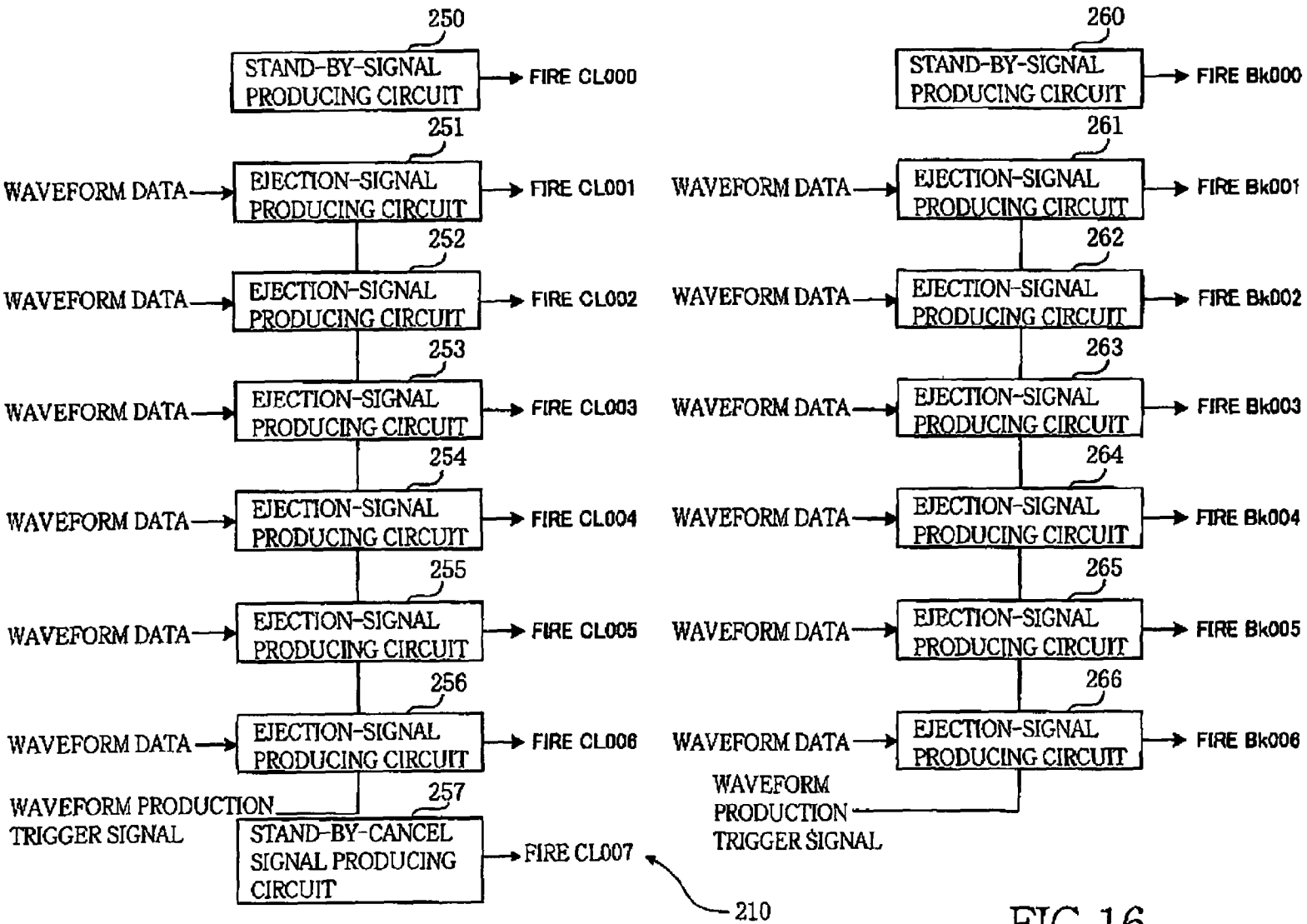
FIG. 16 is a diagrammatic view corresponding to FIG. 10, showing a waveform producing circuit that is employed by another ink jet printer as a second embodiment of the present invention.

FIG. 16 is a diagrammatic view corresponding to FIG. 10, showing, in detail a construction of a waveform producing circuit 210 that may be employed, by the ink jet printer 100, in place of the waveform producing circuit 110. The waveform producing circuit 210 includes a first circuit that produces signals corresponding to the three chromatic color inks, i.e., cyan, magenta, and yellow inks, and a second circuit that produces signals corresponding to the monochromatic color ink, i.e., black ink. The first circuit includes a stand-by-signal producing circuit 250 that produces a stand-by signal; six ejection-signal producing circuits 251, 252, 253, 254, 255, 256 that produce six ejection signals, respectively; and a stand-by-cancel-signal producing circuit 257 that produces a stand-by cancel signal. The second circuit includes a stand-by-signal producing circuit 260 that produces a stand-by signal; and six ejection-signal producing circuits 261, 262, 263, 264, 265, 266 that produce six ejection signals, respectively.

The respective signals outputted by the stand-by-signal producing circuits 250, 260 and the ejection-signal producing circuits 251 through 256, 261 through 266 will be inverted by each of the four driver ICs 103. When each of the ejection-signal producing circuits 251 through 256, 261 through 266 receives a waveform-production trigger signal from the main control portion 116, the each circuit produces an ejection signal. The ejection signals FIRE CL001 through FIRE CL006 produced by the ejection-signal producing circuits 251 through 256 have respective waveforms identical with those of the ejection signals FIRE CL001 through FIRE CL006 shown in FIGS. 11B through 1G. In addition, the ejection signals FIRE Bk001 through FIRE Bk006 produced by the ejection-signal producing circuits 261 through 266 have respective waveforms identical with those of the ejection signals FIRE Bk001 through FIRE Bk006 produced by the ejection-signal producing circuits 161 through 166 employed in the first embodiment.

The stand-by signals FIRE CL000, FIRE Bk000 produced by the stand-by-signal producing circuits 250, 260 have respective waveforms identical with the waveform of the stand-by signal FIRE CL000 shown in FIG. 11A; and the stand-by cancel signal FIRE CL007 produced by the stand-by-cancel-signal producing circuit 257 has a waveform identical with that of the stand-by cancel signal FIRE CL006 shown in FIG. 11H.

Thus, in the second embodiment, the waveform producing circuit 210 does not include the selector 157 that selectively outputs the different signals based on the mode signal outputted by the mode judging circuit 109. However, the waveform producing circuit 210 produces, for each of the three chromatic-ink (i.e., cyan-ink, magenta-ink, and yellow-ink) recording heads 6, the eight signals in total, i.e., the six ejection signals FIRE CL001 through FIRE CL006, the stand-by signal FIRE CL000, and the stand-by cancel signal FIRE CL007. The eight signals are supplied to each of the three driver ICs 103 corresponding to the three chromatic-ink recording heads 6. In addition, the printing data producing circuit 130 produces the eight sorts of three-bit serial printing data SIN0, SIN1, SIN2 shown in FIGS. 12A through 12H, respectively. In particular, the three-bit serial printing data SIN0, SIN1, SIN2, indicated at (h) in FIG. 12, correspond to the stand-by cancel signal FIRE CL007. In addition, unlike the first embodiment, the three-bit serial printing data SIN0, SIN1, SIN2, indicated at (g) in FIG. 12G, correspond to the ejection signal FIRE CL006 only. On the other hand, for the black-ink recording head 6, the waveform producing circuit 210 produces the seven signals in total, and the seven signals are supplied to the corresponding driver IC 103 like the first embodiment.

The four driver ICs 103 used in the second embodiment have respective constructions basically identical with those of the four driver ICs 103 used in the first embodiment, except that the eight signals produced by the waveform producing circuit 210 are supplied to each of the multiplexers 173 corresponding to the three chromatic-ink (i.e., cyan-ink, magenta-ink, and yellow-ink) recording heads 6.

While the present invention has been described in its preferred embodiments, it is to be understood that the present invention is by no means limited to the details of the described embodiments but may otherwise be embodied.

For example, in each of the above-described embodiments, when the ink jet printer 100 is started upon operation of e.g., a start key, not shown, the high-level potential as the stand-by signal (i.e., a first voltage) is applied to all the piezoelectric actuators of the four recording heads 6, so that all the actuators are prepared for actuating the pressure chambers 36, respectively. However, this action may not be taken by the printer 100. More specifically described, in a modified embodiment of the present invention, each of the multiplexers 173 as the signal selector may be adapted to select one of the stand-by signal, the ejection signals, and the stand-by cancel signal, in a state in which no electric voltages are applied to the piezoelectric actuators of the recording heads 6. Thus, in not only the described embodiments but also the modified embodiment, it can be said, regarding the piezoelectric actuators corresponding to the chromatic-ink and monochromatic-ink ejection nozzles 35 in the full-color print mode, or regarding the piezoelectric actuators corresponding to the monochromatic-ink ejection nozzles 35 in the monochromatic print mode, that each multiplexer 173 first selects the stand-by signal as a base signal and subsequently selects, in place of the stand-by signal, one of the ejection signals, as needed. On the other hand, regarding the piezoelectric actuators corresponding to the chromatic-ink ejection nozzles 35 in the monochromatic print mode, each multiplexer 173 may, or may not, be adapted to select the stand-by signal as the base signal.

In addition, in each of the above-described embodiments, the stand-by cancel signal is used to cause the individual electrode 24 of each piezoelectric actuator to have the earth potential. However, the electric potential of the stand-by cancel signal may have a different potential so long as the stand-by cancel signal can cause the individual electrode 24 of each piezoelectric actuator to have an electric potential an absolute value of which is smaller than that of the high-level potential of the ejection signals FIRE CL001 through FIRE CL006.

In each of the illustrated embodiments, the ink jet printer 100 employs the four independent recording heads 6 corresponding to the four color inks, respectively. However, the four independent recording heads 6 may be replaced with a single recording head that can eject all those inks.

In addition, in each of the illustrated embodiments, the ink jet printer 100 is selectively operable in the full-color print mode and the monochromatic print mode. However, the principle of the present invention is applicable to such an ink jet printer that is selectively operable in a magenta-ink print mode and the full-color print mode. Likewise, the present invention is applicable to such an ink jet printer that is selectively operable in a plurality of print modes independent of the color(s) of the ink(s) used, so long as the print modes include at least one print mode in which only a portion of the nozzles 35 are permitted to eject ink and the remaining nozzles 35 are not permitted to eject ink.

In each of the illustrated embodiments, the mode judging circuit 109 judges or determines the print mode based on the image data. However, the mode judging circuit 109 may be replaced with a device that judges or determines a print mode based on information other than image data. For example, the mode judging circuit 109 may be replaced with a key that is manually operable by a user to designate a print mode.

In each of the illustrated embodiments, the printing data producing circuit 130 that produces the printing data based on the image data and the mode signal may be omitted. In this case, the image data and the mode signal may be directly supplied to each of the multiplexers 173 so that the each multiplexer 173 can select one of the signals produced by the waveform producing circuit 110, 210.

In each of the illustrated embodiments, each of the driver ICs 103 includes the shift registers 171 and the D-flip-flops (i.e., latch circuits) 172. However, the each driver IC 103 may be modified not to include the shift registers 171 nor the D-flip-flops 172.

In each of the illustrated embodiments, each of the piezoelectric actuators of the four recording heads 6 may be replaced with a different sort of actuator such as an electrostatic actuator.

The principle of the present invention may be applicable to a different type of ink jet printer than the serial-print-type ink jet printer shown in FIG. 1, such as a line-print-type ink jet printer.

In each of the illustrated embodiments, the high-level potential of the ejection signals supplied to the individual electrode 24 of each piezoelectric actuator is equal to that of the stand-by signal supplied to the same 24, and the low-level potential of the ejection signals supplied to the same 24 is equal to that of the stand-by cancel signal supplied to the same 24. In addition, the respective high-level potentials preceding and following each of the low-level potentials are equal to each other. However, the respective high-level potentials of the ejection signals and the stand-by signal may differ from each other; the respective low-level potential of the ejection signals and the stand-by cancel signal may differ from each other; and the respective high-level potentials preceding and following each low-level potential may differ from each other.

In each of the illustrated embodiments, the waveform producing circuit 110 produces the six sorts of ejection signals. However, the waveform producing circuit 110 may be modified to produce a single sort of ejection signal.

In each of the illustrated embodiments, each of the ejection signals has the waveform defined by the combination of rectangular waves, as shown in a corresponding one of FIGS. 11B through 11G. However, each ejection signal may have a waveform having a different shape, such as a waveform defined by a combination of triangular or sine waves. Here, a construction of an electric circuit to produce the triangular or sine waveform is not described. However, like each of the illustrated embodiments, when the full-color print mode is selected, an ejection signal having a triangular or sine waveform produced based on a stand-by signal as a base signal is applied to one or more piezoelectric actuators corresponding to one or more operative nozzles 35 that are to eject ink, and a stand-by signal is applied to one or more piezoelectric actuators corresponding to one or more stand-by nozzles 35 that are not to eject ink. In addition, when the monochromatic (e.g., black) print mode is selected, an ejection signal having a waveform similar to that of the signal used when the full-color print mode is selected is applied to one or more piezoelectric actuators corresponding to one or more operative nozzles 35 that are to eject the black ink, and a stand-by signal is applied to one or more piezoelectric actuators corresponding to one or more nozzles 35 that are not to eject the black ink. On the other hand, a stand-by cancel signal having the earth potential is applied to all the piezoelectric actuators corresponding to the nozzles 35 of the chromatic-ink (e.g., magenta-ink, cyan-ink, and yellow-ink) recording heads 6. Thus, in this modified case, too, the ink jet printer is freed of the problems caused by the phenomenon of "migration".

It is to be understood that the present invention may be embodied with various changes, modifications, and improvements that may occur to a person skilled in the art without departing from the spirit and scope of the invention defined in the appended claims.

What is claimed is:

1. A driving apparatus for driving an ink jet recording device including a plurality of pressure chambers; a plurality of actuators to each of which a first voltage is applied to decrease a volume of a corresponding one of the pressure chambers from the volume of said one pressure chamber when a second voltage whose absolute value is smaller than an absolute value of the first voltage is applied to said each actuator; at least one first nozzle of a first group that communicates with at least one first pressure chamber of the pressure chambers; and at least one second nozzle of a second group that communicates with at least one second pressure chamber of the pressure chambers that is different from said at least one first pressure chamber, the ink jet recording device selectively operating in a first recording mode in which said at least one first nozzle is permitted to eject a first ink and said at least one second nozzle is permitted to eject a second ink, and in a second recording mode in which said at least one first nozzle is permitted to eject the first ink and said at least one second nozzle is not permitted to eject the second ink, the driving apparatus comprising:

an ejection-signal producer which produces an ejection signal to apply, to said each actuator, at least one voltage cycle including a third voltage, a fourth voltage subsequent to the third voltage, and a fifth voltage subsequent to the fourth voltage, wherein when the fourth voltage is applied to said each actuator, the volume of said one pressure chamber is increased from the volume of said one pressure chamber when the third voltage is applied to said each actuator, and when the fifth voltage is applied to said each actuator, the volume of said one pressure chamber is decreased from the volume of said one pressure chamber when the fourth voltage is applied to said each actuator;

a stand-by-signal producer which produces a stand-by signal to keep applying the first voltage to said each actuator;

a pause-signal producer which produces a pause signal to keep applying the second voltage to said each actuator; and a signal selector which selects, based on a mode signal indicating in which one of the first and second recording modes the ink jet recording device is to operate, and image data indicating whether each of said at least one first nozzle and said at least one second nozzle is to eject a corresponding one of the first ink and the second ink, one of the ejection signal, the stand-by signal and the pause signal, such that when the ink jet recording device is to operate in the first recording mode, the ejection signal is selected as said one signal for being applied to at least one actuator corresponding to at least one operative nozzle of said at least one first nozzle and said at least one second nozzle that is to eject a corresponding one of the first ink and the second ink, and the stand-by signal is selected as said one signal for being applied to at least one actuator corresponding to at least one stand-by nozzle of said at least one first nozzle and said at least one second nozzle that is not to eject a corresponding one of the first ink and the second ink, and such that when the ink jet recording device is to operate in the second recording mode, the ejection signal is selected as said one signal for being applied to at least one actuator corresponding to at least one operative nozzle of said at least one first nozzle that is to eject the first ink, the stand-by signal is selected as said one signal for being applied to at least one actuator corresponding to at least one stand-by nozzle of said at least one first nozzle that is not to eject the first ink, and the pause signal is selected as said one signal for being applied to at least one actuator corresponding to said at least one second nozzle.

2. The driving apparatus according to claim 1, wherein the second voltage is equal to zero volt.

3. The driving apparatus according to claim 1, further comprising a recording-data producer which produces recording data including the mode signal and the image data, wherein the signal selector selects, based on the recording data, said one signal from the ejection signal, the stand-by signal, and the pause signal.

4. The driving apparatus according to claim 3, wherein the recording-data producer produces, as the recording data, a serial signal constituted by a plurality of bits, and wherein the driving apparatus further comprises:

a plurality of shift registers which convert the serial signal into a plurality of parallel signals, respectively, which correspond to the actuators, respectively; and a plurality of latch circuits which latch the parallel signals outputted by the shift registers, respectively.

5. The driving apparatus according to claim 1, wherein the ejection-signal producer produces a plurality of said ejection signals having respective different waveforms, and wherein the signal selector selects said one signal from the ejection signals, the stand-by signal, and the pause signal, such that when the ink jet recording device is to operate in the first recording mode, one of the ejection signals is selected as said one signal for being applied to said at least one actuator corresponding to said at least one operative nozzle of said at least one first nozzle and said at least one second nozzle, and the stand-by signal is selected as said one signal for being applied to said at least one actuator corresponding to said at least one stand-by nozzle of said at least one first nozzle and said at least one second nozzle, and such that when the ink jet recording device is to operate in the second recording mode, one of the ejection signals is selected as said one signal for being applied to said at least one actuator corresponding to said at least one operative nozzle of said at least one first nozzle, the stand-by signal is selected as said one signal for being applied to said at least one actuator corresponding to said at least one stand-by nozzle of said at least one first nozzle, and the pause signal is selected as said one signal for being applied to said at least one actuator corresponding to said at least one second nozzle.

6. The driving apparatus according to claim 5, wherein the signal selector selects, when the ink jet recording device is to operate in the first recording mode, said one signal from (a) the ejection signals including a pre-selected ejection signal, (b) the stand-by signal, and (c) the pause signal, and selects, when the ink jet recording device is to operate in the second recording mode, said one signal from (d) at least one ejection signal obtained by excluding the pre-selected ejection signal from the ejection signals, (b) the stand-by signal, and (c) the pause signal.

7. The driving apparatus according to claim 1, wherein the first ink has a color different from a color of the second ink.

8. The driving apparatus according to claim 7, wherein the first ink has a black color and the second ink has a chromatic color.

9. The driving apparatus according to claim 1, wherein each of the third and fifth voltages is equal to the first voltage, and the fourth voltage is equal to the second voltage.

10. The driving apparatus according to claim 1, wherein the signal selector selects, based on the mode signal and the image data, said one of the ejection signal the stand-by signal and the pause signal, such that when the ink jet recording device is to operate in the first recording mode, first the stand-by signal is selected as said one signal for being applied to each of at least two actuators corresponding to said at least one first nozzle and said at least one second nozzle, and subsequently the ejection signal is selected as said one signal for being applied to said at least one actuator corresponding to said at least one operative nozzle of said at least one first nozzle and said at least one second nozzle and the stand-by signal is kept as said one signal for being applied to said at least one actuator corresponding to said at least one stand-by nozzle of said at least one first nozzle and said at least one second nozzle, and such that when the ink jet recording device is to operate in the second recording mode, first the stand-by signal is selected as said one signal for being applied to at least one actuator corresponding to at least said at least one first nozzle, and subsequently the ejection signal is selected as said one signal for being applied to said at least one actuator corresponding to said at least one operative nozzle of said at least one first nozzle, the stand-by signal is kept as said one signal for being applied to said at least one actuator corresponding to said at least one stand-by nozzle of said at least one first nozzle, and the pause signal is selected as said one signal for being applied to said at least one actuator corresponding to said at least one second nozzle.

11. A driving apparatus for driving an ink jet recording device including a plurality of pressure chambers; a plurality of actuators each of which actuates a corresponding one of the pressure chambers; at least one first nozzle of a first group that communicates with at least one first pressure chamber of the pressure chambers; and at least one second nozzle of a second group that communicates with at least one second pressure chamber of the pressure chambers that is different from said at least one first pressure chamber, the ink jet recording device selectively operating in a first recording mode in which said at least one first nozzle is permitted to eject a first ink and said at least one second nozzle is permitted to eject a second ink, and in a second recording mode in which said at least one first nozzle is permitted to eject the first ink and said at least one second nozzle is not permitted to eject the second ink, the driving apparatus comprising:

a signal-and-data obtainer which obtains a mode signal indicating in which one of the first and second recording modes the ink jet recording device is to operate, and image data indicating whether each of said at least one first nozzle and said at least one second nozzle is to eject a corresponding one of the first ink and the second ink; and a voltage applier which applies, based on the mode signal and the image data obtained by the signal-and-data obtainer, an electric voltage to said each actuator, such that when the ink jet recording device is to operate in the first recording mode, a first voltage not equal to zero volt is applied to at least one actuator corresponding to at least one operative nozzle of said at least one first nozzle and said at least one second nozzle that is to eject a corresponding one of the first ink and the second ink, so that a corresponding one of the pressure chambers has a pre-determined volume, and subsequently at least one first subsequent voltage based on the image data is applied to said at least one actuator corresponding to said at least one operative nozzle of said at least one first nozzle and said at least one second nozzle, and such that when the ink jet recording device is to operate in the second recording mode, the first voltage is applied to at least one actuator corresponding to at least one operative nozzle of said at least one first nozzle that is to eject the first ink, and subsequently at least one second subsequent voltage based on the image data is applied to said at least one actuator corresponding to said at least one operative nozzle of said at least one first nozzle, and a second voltage equal to zero volt is applied to at least one actuator corresponding to said at least one second nozzle.

12. The driving apparatus according to claim 11, wherein the voltage applier comprises an ejection-signal producer which produces, as each of (a) said at least one first subsequent voltage and (b) said at least one second subsequent voltage, an ejection signal to apply, to said each actuator, at least one voltage cycle including a third voltage, a fourth voltage subsequent to the third voltage, and a fifth voltage subsequent to the fourth voltage, and wherein when the fourth voltage is applied to said each actuator, a volume of a corresponding one of the pressure chambers is increased from the volume of said one pressure chamber when the third voltage is applied to said each actuator, and when the fifth voltage is applied to said each actuator, the volume of said one pressure chamber is decreased from the volume of said one pressure chamber when the fourth voltage is applied to said each actuator.

13. An ink jet printer, comprising:

an ink jet recording device; and a driving device which drives the ink jet recording device, wherein the ink jet recording device comprises:

a plurality of pressure chambers, a plurality of actuators to each of which a first voltage is applied to decrease a volume of a corresponding one of the pressure chambers from the volume of said one pressure chamber when a second voltage whose absolute value is smaller than an absolute value of the first voltage is applied to said each actuator, at least one first nozzle of a first group that communicates with at least one first pressure chamber of the pressure chambers, and at least one second nozzle of a second group that communicates with at least one second pressure chamber of the pressure chambers that is different from said at least one first pressure chamber, wherein the ink jet recording device selectively operates in a first recording mode in which said at least one first nozzle is permitted to eject a first ink and said at least one second nozzle is permitted to eject a second ink, and in a second recording mode in which said at least one first nozzle is permitted to eject the first ink and said at least one second nozzle is not permitted to eject the second ink, and wherein the driving device comprises:

an ejection-signal producer which produces an ejection signal to apply, to said each actuator, at least one voltage cycle including a third voltage, a fourth voltage subsequent to the third voltage, and a fifth voltage subsequent to the fourth voltage, wherein when the fourth voltage is applied to said each actuator, the volume of said one pressure chamber is increased from the volume of said one pressure chamber when the third voltage is applied to said each actuator, and when the fifth voltage is applied to said each actuator, the volume of said one pressure chamber is decreased from the volume of said one pressure chamber when the fourth voltage is applied to said each actuator, a stand-by-signal producer which produces a stand-by signal to keep applying the first voltage to said each actuator, a pause-signal producer which produces a pause signal to keep applying the second voltage to said each actuator, and a signal selector which selects, based on a mode signal indicating in which one of the first and second recording modes the ink jet recording device is to operate, and image data indicating whether each of said at least one first nozzle and said at least one second nozzle is to eject a corresponding one of the first ink and the second ink, one of the ejection signal, the stand-by signal and the pause signal, such that when the ink jet recording device is to operate in the first recording mode, the ejection signal is selected as said one signal for being applied to at least one actuator corresponding to at least one operative nozzle of said at least one first nozzle and said at least one second nozzle that is to eject a corresponding one of the first ink and the second ink, and the stand-by signal is selected as said one signal for being applied to at least one actuator corresponding to at least one stand-by nozzle of said at least one first nozzle and said at least one second nozzle that is not to eject a corresponding one of the first and second inks, and such that when the ink jet recording device is to operate in the second recording mode, the ejection signal is selected as said one signal for being applied to at least one actuator corresponding to at least one operative nozzle of said at least one fist nozzle that is to eject the first ink, the stand-by signal is selected as said one signal for being applied to at least one actuator corresponding to at least one stand-by nozzle of said at least one first nozzle that is not to eject the first ink, and the pause signal is selected as said one signal for being applied to at least one actuator corresponding to said at least one second nozzle.

* * * * *